US009660368B2

(12) United States Patent
Rathburn

(10) Patent No.: US 9,660,368 B2
(45) Date of Patent: May 23, 2017

(54) HIGH PERFORMANCE SURFACE MOUNT ELECTRICAL INTERCONNECT

(71) Applicant: HSIO TECHNOLOGIES, LLC, Maple Grove, MN (US)

(72) Inventor: James Rathburn, Maple Grove, MN (US)

(73) Assignee: HSIO Technologies, LLC, Maple Grove, MN (US)

( * ) Notice: Subject to any disclaimer, the term of this patent is extended or adjusted under 35 U.S.C. 154(b) by 231 days.

(21) Appl. No.: 14/621,663

(22) Filed: Feb. 13, 2015

(65) Prior Publication Data

US 2015/0162678 A1 Jun. 11, 2015

Related U.S. Application Data

(63) Continuation of application No. 13/266,486, filed as application No. PCT/US2010/036043 on May 25, 2010, now Pat. No. 8,955,215.
(Continued)

(51) Int. Cl.
*H01R 12/00* (2006.01)
*H01R 12/70* (2011.01)
*H01R 12/57* (2011.01)

(52) U.S. Cl.
CPC ..... *H01R 12/7082* (2013.01); *H01R 12/57* (2013.01); *Y10T 29/4913* (2015.01); *Y10T 29/49144* (2015.01); *Y10T 29/49165* (2015.01)

(58) Field of Classification Search
CPC .... H01R 23/722; H01R 23/725; H01R 9/096; H01R 13/2435; H01R 13/2414; H05K 7/1069; H05K 7/1023; H05K 7/1061
(Continued)

(56) References Cited

U.S. PATENT DOCUMENTS 3,672,986 A 6/1972 Schneble, Jr. et al.
4,188,438 A 2/1980 Burns
(Continued)

FOREIGN PATENT DOCUMENTS

JP 2003/217774 7/2003
WO WO 91/14015 9/1991
(Continued)

OTHER PUBLICATIONS

Notice of Allowance and Fee(s) Due mailed Apr. 9, 2015 in co-pending U.S. Appl. No. 13/266,573, now issued as U.S. Pat. No. 9,054,097.
(Continued)

*Primary Examiner* — Hien Vu

(57) ABSTRACT

An interconnect assembly including a substrate with a plurality of through holes extending from a first surface to a second surface. A plurality of discrete contact member are located in the plurality of through holes. The contact members include proximal ends that are accessible from the second surface, distal ends extending above the first surface, and intermediate portions engaged with an engagement region of the substrate located between the first surface and the recesses. Retention members are coupled with at least a portion of the proximal ends to retain the contact members in the through holes. The retention members can be made from a variety of materials with different levels of conductivity, ranging from highly conductive to non-conductive.

17 Claims, 20 Drawing Sheets

Related U.S. Application Data

(60) Provisional application No. 61/181,937, filed on May 28, 2009.

(58) Field of Classification Search
USPC ..... 439/66, 68, 74, 83
See application file for complete search history.

(56) References Cited

U.S. PATENT DOCUMENTS 4,295,700 A 10/1981 Sado
4,489,999 A 12/1984 Miniet
4,922,376 A 5/1990 Pommer et al.
4,964,948 A 10/1990 Reed
5,014,159 A 5/1991 Butt
5,071,363 A 12/1991 Reylek et al.
5,072,520 A 12/1991 Nelson
5,096,426 A 3/1992 Simpson et al.
5,127,837 A 7/1992 Shah et al.
5,129,573 A 7/1992 Duffey
5,161,983 A 11/1992 Ohno
5,167,512 A 12/1992 Walkup
5,208,068 A 5/1993 Davis et al.
5,237,203 A 8/1993 Massaron
5,246,880 A 9/1993 Reele et al.
5,286,680 A 2/1994 Cain
5,334,029 A 8/1994 Akkapeddi et al.
5,358,621 A 10/1994 Oyama
5,378,981 A 1/1995 Higgins, III
5,419,038 A 5/1995 Wang et al.
5,454,161 A 10/1995 Beilin et al.
5,479,319 A 12/1995 Werther et al.
5,509,019 A 4/1996 Yamamura
5,527,998 A 6/1996 Anderson et al.
5,562,462 A 10/1996 Matsuba et al.
5,659,181 A 8/1997 Bridenbaugh
5,674,595 A 10/1997 Busacco et al.
5,691,041 A 11/1997 Frankeny et al.
5,716,663 A 2/1998 Capote et al.
5,741,624 A 4/1998 Jeng et al.
5,746,608 A 5/1998 Taylor
5,761,801 A 6/1998 Gebhardt et al.
5,764,485 A 6/1998 Lebaschi
5,772,451 A 6/1998 Dozler et al.
5,785,538 A 7/1998 Beaman et al.
5,787,976 A 8/1998 Hamburgen et al.
5,802,699 A 9/1998 Fjelstad et al.
5,802,711 A 9/1998 Card et al.
5,819,579 A 10/1998 Roberts
5,904,546 A 5/1999 Wood et al.
5,913,109 A 6/1999 Distefano et al.
5,921,786 A 7/1999 Slocum et al.
5,925,931 A 7/1999 Yamamoto
5,933,558 A 8/1999 Sauvageau et al.
5,973,394 A 10/1999 Slocum et al.
6,020,597 A 2/2000 Kwak
6,062,879 A 5/2000 Beaman et al.
6,080,932 A 6/2000 Smith et al.
6,107,109 A 8/2000 Akram et al.
6,114,240 A 9/2000 Akram et al.
6,118,426 A 9/2000 Albert
6,120,588 A 9/2000 Jacobson
6,137,687 A 10/2000 Shirai et al.
6,172,879 B1 1/2001 Cilia et al.
6,177,921 B1 1/2001 Comiskey
6,178,540 B1 1/2001 Lo et al.
6,181,144 B1 1/2001 Hembree et al.
6,200,143 B1 3/2001 Haba et al.
6,207,259 B1 3/2001 Iino et al.
6,225,692 B1 5/2001 Hinds
6,247,938 B1 6/2001 Rathburn
6,252,564 B1 6/2001 Albert
6,255,126 B1 7/2001 Mathieu et al.
6,263,566 B1 7/2001 Hembree et al.
6,270,363 B1 8/2001 Brofman et al.
6,288,451 B1 9/2001 Tsao
6,312,971 B1 11/2001 Amundson
6,313,528 B1 11/2001 Solberg
6,320,256 B1 11/2001 Ho
6,350,386 B1 2/2002 Lin
6,359,790 B1 3/2002 Meyer-Berg
6,413,790 B1 7/2002 Duthaler
6,422,687 B1 7/2002 Jacobson
6,428,328 B2 8/2002 Haba et al.
6,437,452 B2 8/2002 Lin
6,437,591 B1 8/2002 Farnworth et al.
6,459,418 B1 10/2002 Comiskey
6,461,183 B1 10/2002 Ohkita
6,462,418 B2 10/2002 Sakamoto et al.
6,462,568 B1 10/2002 Cram
6,477,286 B1 11/2002 Ouchi
6,490,786 B2 12/2002 Belke et al.
6,494,725 B2 12/2002 Lin et al.
6,506,438 B2 1/2003 Duthaler et al.
6,521,489 B2 2/2003 Duthaler
6,545,291 B1 4/2003 Amundson
6,572,396 B1 6/2003 Rathburn
6,574,114 B1 6/2003 Brindle et al.
6,593,535 B2 7/2003 Gailus
6,603,080 B2 8/2003 Jensen
6,614,104 B2 9/2003 Farnworth et al.
6,626,526 B2 9/2003 Ueki
6,639,578 B1 10/2003 Comiskey
6,642,127 B2 11/2003 Kumar et al.
6,652,075 B2 11/2003 Jacobson
6,661,084 B1 12/2003 Peterson et al.
6,662,442 B1 12/2003 Matsui et al.
6,709,967 B2 3/2004 Evers
6,744,126 B1 6/2004 Chiang
6,750,473 B2 6/2004 Amundson
6,758,691 B1 7/2004 McHugh
6,773,302 B2 8/2004 Gutierrez et al.
6,796,810 B2 * 9/2004 DelPrete ..... H01R 13/2414 439/66
6,800,169 B2 10/2004 Liu et al.
6,809,414 B1 10/2004 Lin et al.
6,821,131 B2 11/2004 Suzuki et al.
6,823,124 B1 11/2004 Renn
6,825,829 B1 11/2004 Albert
6,827,611 B1 12/2004 Payne et al.
6,830,460 B1 12/2004 Rathburn
6,840,777 B2 1/2005 Sathe et al.
6,853,087 B2 2/2005 Neuhaus et al.
6,856,151 B1 2/2005 Cram
6,857,880 B2 * 2/2005 Ohtsuki ..... H01R 13/2414 439/66
6,861,345 B2 3/2005 Ball et al.
6,910,897 B2 6/2005 Driscoll et al.
6,946,325 B2 9/2005 Yean et al.
6,962,829 B2 11/2005 Glenn et al.
6,965,168 B2 11/2005 Langhorn
6,967,640 B2 11/2005 Albert
6,971,902 B2 12/2005 Taylor
6,987,661 B1 1/2006 Huemoeller et al.
6,992,376 B2 1/2006 Jaeck
7,009,413 B1 3/2006 Alghouli
7,025,600 B2 4/2006 Higashi
7,029,289 B2 4/2006 Li
7,040,902 B2 5/2006 Li
7,045,015 B2 5/2006 Renn
7,064,412 B2 6/2006 Geissinger et al.
7,070,419 B2 7/2006 Brown et al.
7,095,090 B2 8/2006 Nakajiman et al.
7,101,210 B2 9/2006 Lin
7,114,960 B2 10/2006 Rathburn
7,118,391 B2 10/2006 Minich et al.
7,121,837 B2 10/2006 Sato et al.
7,121,839 B2 10/2006 Rathburn
7,129,166 B2 10/2006 Speakman
7,138,328 B2 11/2006 Downey et al.
7,145,228 B2 12/2006 Yean et al.
7,148,128 B2 12/2006 Jacobson
7,154,175 B2 12/2006 Shrivastava et al.
7,157,799 B2 1/2007 Noquil et al.
7,180,313 B2 2/2007 Bucksch

(56) References Cited

U.S. PATENT DOCUMENTS 7,217,996 B2 5/2007 Cheng et al.
7,220,287 B1 5/2007 Wyrzykowska et al.
7,229,293 B2 6/2007 Sakurai et al.
7,232,263 B2 6/2007 Sashinaka et al.
7,244,967 B2 7/2007 Hundt et al.
7,249,954 B2 7/2007 Weiss
7,276,919 B1 10/2007 Beaman et al.
7,297,003 B2 * 11/2007 Rathburn ..... H01R 12/57 439/591
7,301,105 B2 11/2007 Vasoya
7,321,168 B2 1/2008 Tao
7,326,064 B2 2/2008 Rathburn
7,327,006 B2 2/2008 Svard et al.
7,337,537 B1 3/2008 Smetana, Jr.
7,382,363 B2 6/2008 Albert et al.
7,402,515 B2 7/2008 Arana et al.
7,410,825 B2 8/2008 Majumdar et al.
7,411,304 B2 8/2008 Kirby et al.
7,417,299 B2 8/2008 Hu
7,417,314 B1 8/2008 Lin et al.
7,423,219 B2 9/2008 Kawaguchi et al.
7,427,717 B2 9/2008 Morimoto et al.
7,432,600 B2 10/2008 Klein et al.
7,458,150 B2 12/2008 Totokawa et al.
7,459,393 B2 12/2008 Farnworth et al.
7,485,345 B2 2/2009 Renn
7,489,524 B2 2/2009 Green et al.
7,508,076 B2 3/2009 Japp et al.
7,527,502 B2 5/2009 Li
7,531,906 B2 5/2009 Lee
7,536,714 B2 5/2009 Yuan
7,537,461 B2 5/2009 Rathburn
7,538,415 B1 5/2009 Lin et al.
7,563,645 B2 7/2009 Jaeck
7,595,454 B2 9/2009 Kresge et al.
7,619,309 B2 11/2009 Drexl et al.
7,621,761 B2 11/2009 Mok et al.
7,628,617 B2 12/2009 Brown et al.
7,632,106 B2 12/2009 Nakamura
7,645,635 B2 1/2010 Wood et al.
7,651,382 B2 1/2010 Yasumura et al.
7,658,163 B2 2/2010 Renn
7,674,671 B2 3/2010 Renn
7,726,984 B2 6/2010 Bumb et al.
7,736,152 B2 6/2010 Hougham et al.
7,748,110 B2 7/2010 Asahi et al.
7,758,351 B2 7/2010 Brown et al.
7,800,916 B2 9/2010 Blackwell et al.
7,833,832 B2 11/2010 Wood et al.
7,836,587 B2 11/2010 Kim
7,868,469 B2 1/2011 Mizoguchi
7,874,847 B2 1/2011 Matsui et al.
7,897,503 B2 3/2011 Foster et al.
7,898,087 B2 3/2011 Chainer
7,955,088 B2 6/2011 Di Stefano
7,999,369 B2 8/2011 Malhan et al.
8,044,502 B2 10/2011 Rathburn
8,058,558 B2 11/2011 Mok et al.
8,072,058 B2 12/2011 Kim et al.
8,114,687 B2 2/2012 Mizoguchi
8,120,173 B2 2/2012 Forman et al.
8,148,643 B2 4/2012 Hirose et al.
8,154,119 B2 4/2012 Yoon et al.
8,158,503 B2 4/2012 Abe
8,159,824 B2 4/2012 Cho et al.
8,178,978 B2 5/2012 McElrea et al.
8,203,207 B2 6/2012 Getz et al.
8,227,703 B2 7/2012 Maruyama et al.
8,232,632 B2 7/2012 Rathburn
8,247,702 B2 8/2012 Kouya
8,278,141 B2 10/2012 Chow et al.
8,299,494 B2 10/2012 Yilmaz et al.
8,329,581 B2 12/2012 Haba et al.
8,344,516 B2 1/2013 Chainer
8,373,428 B2 2/2013 Eldridge et al.
8,421,151 B2 4/2013 Yamashita
8,525,322 B1 9/2013 Kim et al.
8,525,346 B2 9/2013 Rathburn
8,536,714 B2 9/2013 Sakagushi
8,536,889 B2 9/2013 Nelson et al.
8,610,265 B2 12/2013 Rathburn
8,618,649 B2 12/2013 Rathburn
8,758,067 B2 6/2014 Rathburn
8,789,272 B2 7/2014 Rathburn
8,803,539 B2 8/2014 Rathburn
8,829,671 B2 9/2014 Rathburn
8,912,812 B2 12/2014 Rathburn
8,928,344 B2 1/2015 Rathburn
8,955,215 B2 2/2015 Rathburn
8,955,216 B2 2/2015 Rathburn
8,970,031 B2 3/2015 Rathburn
8,981,568 B2 3/2015 Rathburn
8,981,809 B2 3/2015 Rathburn
8,984,748 B2 3/2015 Rathburn
8,987,886 B2 3/2015 Rathburn
8,988,093 B2 3/2015 Rathburn
2001/0012707 A1 8/2001 Ho et al.
2001/0016551 A1 8/2001 Yishio et al.
2002/0011639 A1 1/2002 Carlson et al.
2002/0027441 A1 3/2002 Akrma et al.
2002/0062200 A1 5/2002 Mori et al.
2002/0079912 A1 6/2002 Shahriari et al.
2002/0088116 A1 7/2002 Milkovich et al.
2002/0098740 A1 7/2002 Ooya
2002/0105080 A1 8/2002 Speakman
2002/0105087 A1 8/2002 Forbes et al.
2002/0160103 A1 10/2002 Fukunaga et al.
2003/0003779 A1 1/2003 Rathburn
2003/0096512 A1 5/2003 Cornell
2003/0114029 A1 6/2003 Lee et al.
2003/0117161 A1 6/2003 Burns
2003/0156400 A1 8/2003 Dibene et al.
2003/0162418 A1 8/2003 Yamada
2003/0164548 A1 9/2003 Lee
2003/0188890 A1 10/2003 Bhatt et al.
2003/0189083 A1 10/2003 Olsen
2003/0231819 A1 12/2003 Palmer et al.
2004/0016995 A1 1/2004 Kuo et al.
2004/0029411 A1 2/2004 Rathburn
2004/0048523 A1 3/2004 Huang et al.
2004/0054031 A1 3/2004 Jacobson
2004/0070042 A1 4/2004 Lee et al.
2004/0077190 A1 4/2004 Huang et al.
2004/0174180 A1 9/2004 Fukushima et al.
2004/0183557 A1 9/2004 Akram
2004/0184219 A1 9/2004 Otsuka et al.
2004/0217473 A1 11/2004 Shen
2004/0243348 A1 12/2004 Minatani
2005/0020116 A1 1/2005 Kawazoe et al.
2005/0048680 A1 3/2005 Matsumani
2005/0100294 A1 5/2005 Nguyen et al.
2005/0101164 A1 5/2005 Rathburn
2005/0162176 A1 7/2005 Bucksch
2005/0164527 A1 7/2005 Radza et al.
2005/0196511 A1 9/2005 Garrity et al.
2005/0253610 A1 11/2005 Cram
2006/0001152 A1 1/2006 Hu
2006/0006534 A1 1/2006 Yean et al.
2006/0012966 A1 1/2006 Chakravorty
2006/0024924 A1 2/2006 Haji et al.
2006/0044357 A1 3/2006 Andersen
2006/0087064 A1 4/2006 Daniel et al.
2006/0125500 A1 6/2006 Watkins et al.
2006/0145338 A1 7/2006 Dong
2006/0149491 A1 7/2006 Flach et al.
2006/0157103 A1 7/2006 Sheats et al.
2006/0160379 A1 7/2006 Rathburn
2006/0186906 A1 8/2006 Bottoms et al.
2006/0208230 A1 9/2006 Cho et al.
2006/0258912 A1 11/2006 Belson et al.
2006/0261827 A1 11/2006 Cooper et al.
2006/0265919 A1 11/2006 Huang
2006/0281303 A1 12/2006 Trezza et al.
2007/0021002 A1 1/2007 Laurx et al.

(56) References Cited

U.S. PATENT DOCUMENTS

| | | | |
|---|---|---|---|
| 2007/0057382 | A1 | 3/2007 | Liu et al. |
| 2007/0059901 | A1 | 3/2007 | Majumdar et al. |
| 2007/0145981 | A1 | 6/2007 | Tomita et al. |
| 2007/0148822 | A1 | 6/2007 | Haba et al. |
| 2007/0170595 | A1 | 7/2007 | Sinha |
| 2007/0182431 | A1 | 8/2007 | Komatsu et al. |
| 2007/0201209 | A1 | 8/2007 | Francis et al. |
| 2007/0221404 | A1 | 9/2007 | Das et al. |
| 2007/0224735 | A1 | 9/2007 | Karashima et al. |
| 2007/0232059 | A1 | 10/2007 | Abe |
| 2007/0259539 | A1 | 11/2007 | Brown et al. |
| 2007/0267138 | A1 | 11/2007 | White et al. |
| 2007/0269999 | A1 | 11/2007 | Di Stefano |
| 2007/0273394 | A1 | 11/2007 | Tanner et al. |
| 2007/0287304 | A1 | 12/2007 | Eldridge |
| 2007/0289127 | A1 | 12/2007 | Hurwitz et al. |
| 2007/0296090 | A1 | 12/2007 | Hembree |
| 2008/0008822 | A1 | 1/2008 | Kowalski |
| 2008/0020566 | A1 | 1/2008 | Egitto et al. |
| 2008/0020624 | A1 | 1/2008 | Nikaido et al. |
| 2008/0041822 | A1 | 2/2008 | Wang |
| 2008/0057753 | A1 | 3/2008 | Rathburn et al. |
| 2008/0060838 | A1 | 3/2008 | Chen et al. |
| 2008/0073110 | A1 | 3/2008 | Shioga et al. |
| 2008/0093115 | A1 | 4/2008 | Lee |
| 2008/0115961 | A1 | 5/2008 | Mok et al. |
| 2008/0143358 | A1 | 6/2008 | Breinlinger |
| 2008/0143367 | A1 | 6/2008 | Chabineau-Lovgren |
| 2008/0156856 | A1 | 7/2008 | Barausky et al. |
| 2008/0157361 | A1 | 7/2008 | Wood et al. |
| 2008/0185180 | A1 | 8/2008 | Cheng et al. |
| 2008/0197867 | A1 | 8/2008 | Wokhlu et al. |
| 2008/0220584 | A1 | 9/2008 | Kim et al. |
| 2008/0241997 | A1 | 10/2008 | Sunohara et al. |
| 2008/0246136 | A1 | 10/2008 | Haba et al. |
| 2008/0248596 | A1 | 10/2008 | Das et al. |
| 2008/0250363 | A1 | 10/2008 | Goto et al. |
| 2008/0265919 | A1 | 10/2008 | Izadian |
| 2008/0290885 | A1 | 11/2008 | Matsunami |
| 2008/0309349 | A1 | 12/2008 | Sutono |
| 2009/0039496 | A1 | 2/2009 | Beer et al. |
| 2009/0058444 | A1 | 3/2009 | McIntyre |
| 2009/0061089 | A1 | 3/2009 | King |
| 2009/0127698 | A1 | 5/2009 | Rathburn |
| 2009/0133906 | A1 | 5/2009 | Baek |
| 2009/0158581 | A1 | 6/2009 | Nguyen et al. |
| 2009/0180236 | A1 | 7/2009 | Lee et al. |
| 2009/0224404 | A1 | 9/2009 | Wood et al. |
| 2009/0241332 | A1 | 10/2009 | Lauffer et al. |
| 2009/0267628 | A1 | 10/2009 | Takase |
| 2009/0321915 | A1 | 12/2009 | Hu et al. |
| 2010/0133680 | A1 | 6/2010 | Kang et al. |
| 2010/0143194 | A1 | 6/2010 | Lee et al. |
| 2010/0213960 | A1 | 8/2010 | Mok et al. |
| 2010/0300734 | A1 | 12/2010 | Ables et al. |
| 2011/0083881 | A1 | 4/2011 | Nguyen et al. |
| 2011/0101540 | A1 | 5/2011 | Chainer |
| 2012/0017437 | A1 | 1/2012 | Das et al. |
| 2012/0043119 | A1 | 2/2012 | Rathburn |
| 2012/0043130 | A1 | 2/2012 | Rathburn |
| 2012/0043667 | A1 | 2/2012 | Rathburn |
| 2012/0044659 | A1 | 2/2012 | Rathburn |
| 2012/0049342 | A1 | 3/2012 | Rathburn |
| 2012/0049877 | A1 | 3/2012 | Rathburn |
| 2012/0051016 | A1 | 3/2012 | Rathburn |
| 2012/0055701 | A1 | 3/2012 | Rathburn |
| 2012/0055702 | A1 | 3/2012 | Rathburn |
| 2012/0056332 | A1 | 3/2012 | Rathburn |
| 2012/0056640 | A1 | 3/2012 | Rathburn |
| 2012/0058653 | A1 | 3/2012 | Rathburn |
| 2012/0061846 | A1 | 3/2012 | Rathburn |
| 2012/0061851 | A1 | 3/2012 | Rathburn |
| 2012/0062270 | A1 | 3/2012 | Rathburn |
| 2012/0068727 | A1 | 3/2012 | Rathburn |
| 2012/0161317 | A1 | 6/2012 | Rathburn |
| 2012/0164888 | A1 | 6/2012 | Rathburn |
| 2012/0168948 | A1 | 7/2012 | Rathburn |
| 2012/0171907 | A1 | 7/2012 | Rathburn |
| 2012/0182035 | A1 | 7/2012 | Rathburn |
| 2012/0199985 | A1 | 8/2012 | Rathburn |
| 2012/0202364 | A1 | 8/2012 | Rathburn |
| 2012/0244728 | A1 | 9/2012 | Rathburn |
| 2012/0252164 | A1 | 10/2012 | Nakao et al. |
| 2012/0257343 | A1 | 10/2012 | Das et al. |
| 2012/0268155 | A1 | 10/2012 | Rathburn |
| 2013/0078860 | A1 | 3/2013 | Rathburn |
| 2013/0105984 | A1 | 5/2013 | Rathburn |
| 2013/0203273 | A1 | 8/2013 | Rathburn |
| 2013/0206468 | A1 | 8/2013 | Rathburn |
| 2013/0210276 | A1 | 8/2013 | Rathburn |
| 2013/0223034 | A1 | 8/2013 | Rathburn |
| 2013/0244490 | A1 | 9/2013 | Rathburn |
| 2013/0330942 | A1 | 12/2013 | Rathburn |
| 2014/0043782 | A1 | 2/2014 | Rathburn |
| 2014/0080258 | A1 | 3/2014 | Rathburn |
| 2014/0192498 | A1 | 7/2014 | Rathburn |
| 2014/0220797 | A1 | 8/2014 | Rathburn |
| 2014/0225255 | A1 | 8/2014 | Rathburn |
| 2014/0242816 | A1 | 8/2014 | Rathburn |
| 2015/0013901 | A1 | 1/2015 | Rathburn |
| 2015/0091600 | A1 | 4/2015 | Rathburn |
| 2015/0136467 | A1 | 5/2015 | Rathburn |
| 2015/0181710 | A1 | 6/2015 | Rathburn |

FOREIGN PATENT DOCUMENTS

| | | |
|---|---|---|
| WO | WO 2006/039277 | 4/2006 |
| WO | WO 2006/124597 | 11/2006 |
| WO | WO 2008/156856 | 12/2008 |
| WO | WO 2010/138493 | 12/2010 |
| WO | WO 2010/141264 | 12/2010 |
| WO | WO 2010/141266 | 12/2010 |
| WO | WO 2010/141295 | 12/2010 |
| WO | WO 2010/141296 | 12/2010 |
| WO | WO 2010/141297 | 12/2010 |
| WO | WO 2010/141298 | 12/2010 |
| WO | WO 2010/141303 | 12/2010 |
| WO | WO 2010/141311 | 12/2010 |
| WO | WO 2010/141313 | 12/2010 |
| WO | WO 2010/141316 | 12/2010 |
| WO | WO 2010/141318 | 12/2010 |
| WO | WO 2010/147782 | 12/2010 |
| WO | WO 2010/147934 | 12/2010 |
| WO | WO 2010/147939 | 12/2010 |
| WO | WO 2011/002709 | 1/2011 |
| WO | WO 2011/002712 | 1/2011 |
| WO | WO 2011/097160 | 8/2011 |
| WO | WO 2011/139619 | 11/2011 |
| WO | WO 2011/153298 | 12/2011 |
| WO | WO 2012/061008 | 5/2012 |
| WO | WO 2012/074963 | 6/2012 |
| WO | WO 2012/074969 | 6/2012 |
| WO | WO 2012/078493 | 6/2012 |
| WO | WO 2012/122142 | 9/2012 |
| WO | WO 2012/125331 | 9/2012 |
| WO | WO 2013/036565 | 3/2013 |
| WO | WO 2014/011226 | 1/2014 |
| WO | WO 2014/011228 | 1/2014 |
| WO | WO 2014/011232 | 1/2014 |
| WO | WO-2015/006393 | 1/2015 |

OTHER PUBLICATIONS

Notice of Allowance and Fee(s) Due mailed Apr. 13, 2015 in co-pending U.S. Appl. No. 13/318,200, now published as US Patent Application Publication No. US 2012/0056332.

Notice of Allowance and Fee(s) Due mailed May 18, 2015 in co-pending U.S. Appl. No. 14/086,029, now issued as U.S. Pat. No. 9,076,884.

Final Office Action mailed Jun. 30, 2015 in co-pending U.S. Appl. No. 13/318,369, now published as US Patent Application Publication No. US 2012/0043119.

(56) References Cited

OTHER PUBLICATIONS

Office Action mailed Apr. 23, 2015 in co-pending U.S. Appl. No. 13/319,158, now published as US Patent Application Publication No. 2012/0051016.
Office Action mailed Apr. 2, 2015 in co-pending U.S. Appl. No. 13/700,639, now published as US Patent Application Publication No. 2013/0078860.
Final Office Action mailed Apr. 23, 2015 in co-pending U.S. Appl. No. 13/879,783, now published as US Patent Application Publication No. 2013/0223034.
Notice of Allowance and Fee(s) Due mailed May 28, 2015 in co-pending U.S. Appl. No. 13/879,883, now published as US Patent Application Publication No. 2013/0244490.
Office Action mailed May 22, 2015 in co-pending U.S. Appl. No. 13/880,231, now published as US Patent Application Publication No. 2013/0210276.
Office Action mailed May 4, 2015 in co-pending U.S. Appl. No. 13/880,231, now published as US Patent Application Publication No. 2013/0210276.
Notice of Allowance and Fee(s) Due mailed Jun. 4, 2015 in co-pending U.S. Appl. No. 13/410,914, now published as US Patent Application Publication No. US 2012/0164888.
Notification of Transmittal of the International Search Report and the Written Opinion of the International Searching Authority mailed Jul. 30, 2010 in International Application No. PCT/US2010/036043.
Notification of Transmittal of the International Search Report and the Written Opinion of the International Searching Authority mailed Jul. 21, 2010 in International Application No. PCT/US2010/036047.
Notification of Transmittal of the International Search Report and the Written Opinion of the International Searching Authority mailed Jul. 28, 2010 in International Application No. PCT/US2010/036363.
Notification of Transmittal of the International Search Report and the Written Opinion of the International Searching Authority mailed Jul. 28, 2010 in International Application No. PCT/US2010/036377.
Notification of Transmittal of the International Search Report and the Written Opinion of the International Searching Authority mailed Jul. 30, 2010 in International Application No. PCT/US2010/036388.
Notification of Transmittal of the International Search Report and the Written Opinion of the International Searching Authority mailed Jul. 27, 2010 in International Application No. PCT/US2010/036397.
Notification of Transmittal of the International Search Report and the Written Opinion of the International Searching Authority mailed Jul. 30, 2010 in International Application No. PCT/US2010/036055.
Notification of Transmittal of the International Search Report and the Written Opinion of the International Searching Authority mailed Aug. 4, 2010 in International Application No. PCT/US2010/036288.
Notification of Transmittal of the International Search Report and the Written Opinion of the International Searching Authority mailed Aug. 4, 2010 in International Application No. PCT/US2010/036285.
Notification of Transmittal of the International Search Report and the Written Opinion of the International Searching Authority mailed Jul. 30, 2010 in International Application No. PCT/US2010/036282.
Notification of Transmittal of the International Search Report and the Written Opinion of the International Searching Authority mailed Jul. 30, 2010 in International Application No. PCT/US2010/036295.
Notification of Transmittal of the International Search Report and the Written Opinion of the International Searching Authority mailed Jul. 30, 2010 in International Application No. PCT/US2010/036313.
Notification of Transmittal of the International Search Report and the Written Opinion of the International Searching Authority mailed Aug. 3, 2010 in International Application No. PCT/US2010/037619.
Notification of Transmittal of the International Search Report and the Written Opinion of the International Searching Authority mailed Sep. 7, 2010 in International Application No. PCT/US2010/038600.
Notification of Transmittal of the International Search Report and the Written Opinion of the International Searching Authority mailed Aug. 18, 2010 in International Application No. PCT/US2010/038606.
Notification of Transmittal of the International Search Report and the Written Opinion of the International Searching Authority mailed Sep. 1, 2010 in International Application No. PCT/US2010/040188.
Notification of Transmittal of the International Search Report and the Written Opinion of the International Searching Authority mailed Aug. 20, 2010 in International Application No. PCT/US2010/040197.
Notification of Transmittal of the International Search Report and the Written Opinion of the International Searching Authority mailed Apr. 14, 2011 in International Application No. PCT/US2011/023138.
Notification of Transmittal of the International Search Report and the Written Opinion of the International Searching Authority mailed Aug. 17, 2011 in International Application No. PCT/US2011/033726.
Notification of Transmittal of the International Search Report and the Written Opinion of the International Searching Authority mailed Sep. 27, 2011 in International Application No. PCT/US2011/038845.
Notification of Transmittal of the International Search Report and the Written Opinion of the International Searching Authority mailed Feb. 8, 2012 in International Application No. PCT/US2011/056664.
Notification of Transmittal of the International Search Report and the Written Opinion of the International Searching Authority mailed Mar. 26, 2012 in International Application No. PCT/US2011/062313.
Notification of Transmittal of the International Search Report and the Written Opinion of the International Searching Authority mailed Jun. 20, 2012 in International Application No. PCT/US2012/027813.
Notification of Transmittal of the International Search Report and the Written Opinion of the International Searching Authority mailed Jun. 19, 2012 in International Application No. PCT/US2012/027823.
Notification of Transmittal of the International Search Report and the Written Opinion of the International Searching Authority mailed Nov. 29, 2012 in International Application No. PCT/US2012/053848.
Notification of Transmittal of the International Search Report and the Written Opinion of the International Searching Authority mailed Jun. 3, 2013 in International Application No. PCT/US2013/031395.
Notification of Transmittal of the International Search Report and the Written Opinion of the International Searching Authority mailed Jun. 19, 2013 in International Application No. PCT/US2013/030981.
Notification of Transmittal of the International Search Report and the Written Opinion of the International Searching Authority mailed Jun. 7, 2013 in International Application No. PCT/US2013/030856.
Notification of Transmittal of the International Search Report and the Written Opinion of the International Searching Authority mailed Oct. 27, 2014 in International Application No. PCT/US2014/045856.
Tarzwell, Robert, "A Real Printed Electronic Replacement for PCB Fabrication," PCB007 Magazine, May 19, 2009.
Tarzwell, Robert, "Green PCB Manufacturing Announced," Electrical Engineering Times, May 18, 2009.
Tarzwell, Robert, "Can Printed Electronics Replace PCB Technology?" PCB007 Magazine, May 14, 2009.
Tarzwell, Robert, "The Bleeding Edge: Printed Electronics, Inkjets and Silver Ink," PCB007 Magazine, May 6, 2009.
Tarzwell, Robert, "Integrating Printed Electronics and PCB Technologies," Printed Electronics World, Jul. 14, 2009.

(56) References Cited

OTHER PUBLICATIONS

Tarzwell, Robert, "Printed Electronics: The Next Generation of PCBs?" PCB007 Magazine, Apr. 28, 2009.
Liu, et al, "All-Polymer Capacitor Fabricated with Inkjet Printing Technique," Solid-State Electronics, vol. 47, pp. 1543-1548 (2003).
Print—Definition of Print by The Free Dictionary, http://www.thefreedictionary.com/print, Aug. 13, 2014.
Restriction Requirement mailed Jun. 13, 2013 in co-pending U.S. Appl. No. 13/266,486, now published as US Patent Application Publication No. US 2012/0055701.
Response to Restriction Requirement filed Jul. 15, 2013 in co-pending U.S. Appl. No. 13/266,486, now published as US Patent Application Publication No. US 2012/0055701.
Restriction Requirement mailed Sep. 25, 2013 in co-pending U.S. Appl. No. 13/266,486, now published as US Patent Application Publication No. US 2012/0055701.
Response to Restriction Requirement filed Oct. 2, 2013 in co-pending U.S. Appl. No. 13/266,486, now published as US Patent Application Publication No. US 2012/0055701.
Office Action mailed Oct. 30, 2013 in co-pending U.S. Appl. No. 13/266,486, now published as US Patent Application Publication No. US 2012/0055701.
Amendment and Response filed Nov. 6, 2013 in co-pending U.S. Appl. No. 13/266,486, now published as US Patent Application Publication No. US 2012/0055701.
Notice of Non-Compliant Amended mailed Nov. 15, 2013 in co-pending U.S. Appl. No. 13/266,486, now published as US Patent Application Publication No. US 2012/0055701.
Response and Examiner's Interview Summary filed Nov. 20, 2013 in co-pending U.S. Appl. No. 13/266,486, now published as US Patent Application Publication No. US 2012/0055701.
Final Office Action mailed May 15, 2014 in co-pending U.S. Appl. No. 13/266,486, now published as US Patent Application Publication No. US 2012/0055701.
Amendment and Response Under Rule 1.116 filed Jul. 10, 2014 in co-pending U.S. Appl. No. 13/266,486, now published as US Patent Application Publication No. US 2012/0055701.
Advisory Action mailed Jul. 21, 2014 in co-pending U.S. Appl. No. 13/266,486, now published as US Patent Application Publication No. US 2012/0055701.
Request for Continued Examination filed Jul. 31, 2014 in co-pending U.S. Appl. No. 13/266,486, now published as US Patent Application Publication No. US 2012/0055701.
Ex Parte Quayle Action mailed Oct. 1, 2014 in co-pending U.S. Appl. No. 13/266,486, now published as US Patent Application Publication No. US 2012/0055701.
Amendment and Response After ExParte Quayle Action filed Oct. 6, 2014 in co-pending U.S. Appl. No. 13/266,486, now published as US Patent Application Publication No. US 2012/0055701.
Notice of Non-Compliant Amendment mailed Oct. 14, 2014 in co-pending U.S. Appl. No. 13/266,486, now published as US Patent Application Publication No. US 2012/0055701.
Corrected Amendment and Response filed Oct. 15, 2014 in co-pending U.S. Appl. No. 13/266,486, now published as US Patent Application Publication No. US 2012/0055701.
Notice of Allowance and Fee(s) Due mailed Nov. 24, 2014 in co-pending U.S. Appl. No. 13/266,486, now published as US Patent Application Publication No. US 2012/0055701.
Supplemental Notice of Allowance mailed Dec. 24, 2014 in co-pending U.S. Appl. No. 13/266,486, now published as US Patent Application Publication No. US 2012/0055701.
Notice of Allowance and Fee(s) Due mailed May 2, 2014 in co-pending U.S. Appl. No. 13/266,522, now issued as U.S. Pat. No. 8,803,539.
Restriction Requirement mailed Oct. 1, 2013 in co-pending U.S. Appl. No. 13/319,145, now published as US Patent Application Publication No. 2012/0049342.
Response to Restriction Requirement filed Oct. 4, 2013 in co-pending U.S. Appl. No. 13/319,145, now published as US Patent Application Publication No. 2012/0049342.
Office Action mailed Dec. 26, 2013 in co-pending U.S. Appl. No. 13/319,145, now published as US Patent Application Publication No. 2012/0049342.
Amendment and Response filed Mar. 18, 2014 in co-pending U.S. Appl. No. 13/319,145, now published as US Patent Application Publication No. 2012/0049342.
Final Office Action mailed Aug. 4, 2014 in co-pending U.S. Appl. No. 13/319,145, now published as US Patent Application Publication No. 2012/0049342.
Applicant-Initiated Interview Summary mailed Sep. 12, 2014 in co-pending U.S. Appl. No. 13/319,145 now published as US Patent Application Publication No. US 2012/0049342.
Amendment and Response Under Rule 1.116 filed Sep. 18, 2014 in co-pending U.S. Appl. No. 13/319,145 now published as US Patent Application Publication No. US 2012/0049342.
Notice of Allowance and Fee(s) Due mailed Dec. 19, 2014 in co-pending U.S. Appl. No. 13/319,145 now published as US Patent Application Publication No. US 2012/0049342.
Office Action mailed Nov. 22, 2013 in co-pending U.S. Appl. No. 13/266,907, now issued as U.S. Pat. No. 8,928,344.
Amendment and Response filed Jan. 3, 2014 in co-pending U.S. Appl. No. 13/266,907, now issued as U.S. Pat. No. 8,928,344.
Supplemental Amendment and Response filed Jan. 29, 2014 in co-pending U.S. Appl. No. 13/266,907, now issued as U.S. Pat. No. 8,928,344.
Final Office Action mailed May 7, 2014 in co-pending U.S. Appl. No. 13/266,907, now issued as U.S. Pat. No. 8,928,344.
Amendment and Response Under Rule 1.116 mailed Jul. 10, 2014 in co-pending U.S. Appl. No. 13/266,907, now issued as U.S. Pat. No. 8,928,344.
Advisory Action mailed Jul. 25, 2014 in co-pending U.S. Appl. No. 13/266,907, now issued as U.S. Pat. No. 8,928,344.
Advisory Action mailed Aug. 8, 2014 in co-pending U.S. Appl. No. 13/266,907, now issued as U.S. Pat. No. 8,928,344.
Amendment and Response to Final Office Action and RCE filed Aug. 26, 2014 in co-pending U.S. Appl. No. 13/266,907, now issued as U.S. Pat. No. 8,928,344.
Notice of Allowance and Fee(s) Due mailed Oct. 8, 2014 in co-pending U.S. Appl. No. 13/266,907, now issued as U.S. Pat. No. 8,928,344.
Office Action mailed Jan. 3, 2014 in co-pending U.S. Appl. No. 13/318,038, now issued as U.S. Pat. No. 8,912,812.
Amendment and Response and Terminal Disclaimer filed Apr. 2, 2014 in co-pending U.S. Appl. No. 13/318,038, now issued as U.S. Pat. No. 8,912,812.
Terminal Disclaimer Review Decision mailed Apr. 2, 2014 in co-pending U.S. Appl. No. 13/318,038, now issued as U.S. Pat. No. 8,912,812.
Final Office Action mailed Aug. 1, 2014 in co-pending U.S. Appl. No. 13/318,038, now issued as U.S. Pat. No. 8,912,812.
Amendment and Response Under Rule 1.116 and Termination Disclaimer filed Sep. 4, 2014 in co-pending U.S. Appl. No. 13/318,038, now issued as U.S. Pat. No. 8,912,812.
Terminal Disclaimer Review Decision mailed Sep. 8, 2014 in co-pending U.S. Appl. No. 13/318,038, now issued as U.S. Pat. No. 8,912,812.
Notice of Allowance and Fee(s) Due mailed Sep. 30, 2014 in co-pending U.S. Appl. No. 13/318,038, now issued as U.S. Pat. No. 8,912,812.
Restriction Requirement mailed Dec. 9, 2013 in co-pending U.S. Appl. No. 13/318,171, now issued as U.S. Pat. No. 8,789,272.
Response to Restriction Requirement filed Dec. 17, 2013 in co-pending U.S. Appl. No. 13/318,171, now issued as U.S. Pat. No. 8,789,272.
Office Action mailed Feb. 14, 2014 in co-pending U.S. Appl. No. 13/318,171, now issued as U.S. Pat. No. 8,789,272.
Amendment and Response filed Feb. 26, 2014 in co-pending U.S. Appl. No. 13/318,171, now issued as U.S. Pat. No. 8,789,272.
Notice of Allowance and Fee(s) Due mailed Mar. 14, 2014 in co-pending U.S. Appl. No. 13/318,171, now issued as U.S. Pat. No. 8,789,272.

(56) References Cited

OTHER PUBLICATIONS

Restriction Requirement mailed Dec. 9, 2013 in co-pending U.S. Appl. No. 13/318,181, now published as US Patent Application Publication No. US 2012/0044659.
Response to Restriction Requirement filed Jan. 28, 2014 in co-pending U.S. Appl. No. 13/318,181, now published as US Patent Application Publication No. US 2012/0044659.
Office Action mailed Apr. 21, 2014 in co-pending U.S. Appl. No. 13/318,181, now published as US Patent Application Publication No. US 2012/0044659.
Amendment and Response filed Jul. 27, 2014 in co-pending U.S. Appl. No. 13/318,181, now published as US Patent Application Publication No. US 2012/0044659.
Notice of Allowance and Fee(s) Due mailed Oct. 24, 2014 in co-pending U.S. Appl. No. 13/318,181, now published as US Patent Application Publication No. US 2012/0044659.
Supplemental Notice of Allowance mailed Dec. 19, 2014 in co-pending U.S. Appl. No. 13/318,181, now published as US Patent Application Publication No. US 2012/0044659.
Restriction Requirement mailed Mar. 1, 2013 in co-pending U.S. Appl. No. 13/318,200, now published as US Patent Application Publication No. US 2012/0056332.
Response to Restriction Requirement filed Mar. 7, 2013 in co-pending U.S. Appl. No. 13/318,200, now published as US Patent Application Publication No. US 2012/0056332.
Office Communication mailed May 30, 2013 in co-pending U.S. Appl. No. 13/318,200, now published as US Patent Application Publication No. US 2012/0056332.
Office Action mailed May 30, 2013 in co-pending U.S. Appl. No. 13/318,200, now published as US Patent Application Publication No. US 2012/0056332.
Amendment and Response filed Jul. 1, 2013 in co-pending U.S. Appl. No. 13/318,200, now published as US Patent Application Publication No. US 2012/0056332.
Final Office Action mailed Nov. 6, 2013 in co-pending U.S. Appl. No. 13/318,200, now published as US Patent Application Publication No. US 2012/0056332.
Amendment and Response to Final Office Action filed Nov. 26, 2013 in co-pending U.S. Appl. No. 13/318,200, now published as US Patent Application Publication No. US 2012/0056332.
Advisory Action mailed Dec. 6, 2013 in co-pending U.S. Appl. No. 13/318,200, now published as US Patent Application Publication No. US 2012/0056332.
Response to Advisory Action filed Dec. 6, 2013 in co-pending U.S. Appl. No. 13/318,200, now published as US Patent Application Publication No. US 2012/0056332.
Request for Continued Examination filed Feb. 11, 2014 in co-pending U.S. Appl. No. 13/318,200, now published as US Patent Application Publication No. US 2012/0056332.
Office Action mailed Nov. 19, 2014 in co-pending U.S. Appl. No. 13/318,200, now published as US Patent Application Publication No. US 2012/0056332.
Office Action mailed Nov. 23, 2012 in co-pending U.S. Appl. No. 13/318,263, now published as US Patent Application Publication No. US 2012/0043667.
Amendment and Response filed Mar. 4, 2013 in co-pending U.S. Appl. No. 13/318,263, now published as US Patent Application Publication No. US 2012/0043667.
Office Action mailed Jul. 10, 2013 in co-pending U.S. Appl. No. 13/318,263, now published as US Patent Application Publication No. US 2012/0043667.
Amendment and Response filed Sep. 24, 2013 in co-pending U.S. Appl. No. 13/318,263, now published as US Patent Application Publication No. US 2012/0043667.
Notice of Allowance mailed Oct. 28, 2013 in co-pending U.S. Appl. No. 13/318,263, now published as US Patent Application Publication No. US 2012/0043667.
Office Action mailed Sep. 10, 2013 in co-pending U.S. Appl. No. 13/320,285, now published as US Patent Application Publication No. US 2012/0055702.
Amendment and Response filed Oct. 2, 2013 in co-pending U.S. Appl. No. 13/320,285, now published as US Patent Application Publication No. US 2012/0055702.
Final Office Action mailed Jan. 8, 2014 in co-pending U.S. Appl. No. 13/320,285, now published as US Patent Application Publication No. US 2012/0055702.
Amendment and Response to Final Office filed Feb. 18, 2014 in co-pending U.S. Appl. No. 13/320,285, now published as US Patent Application Publication No. US 2012/0055702.
Advisory Action mailed Feb. 26, 2014 in co-pending U.S. Appl. No. 13/320,285, now published as US Patent Application Publication No. US 2012/0055702.
RCE filed Mar. 10, 2014 in co-pending U.S. Appl. No. 13/320,285, now published as US Patent Application Publication No. US 2012/0055702.
Office Action mailed Jul. 29, 2014 in co-pending U.S. Appl. No. 13/320,285, now published as US Patent Application Publication No. US 2012/0055702.
Amendment and Response and Examiner's Interview Summary filed Oct. 15, 2014 in co-pending U.S. Appl. No. 13/320,285, now published as US Patent Application Publication No. US 2012/0055702.
Restriction Requirement mailed Sep. 8, 2014 in co-pending U.S. Appl. No. 13/318,369, now published as US Patent Application Publication No. US 2012/0043119.
Response to Restriction Requirement filed Oct. 13, 2014 in co-pending U.S. Appl. No. 13/318,369, now published as US Patent Application Publication No. US 2012/0043119.
Office Action mailed Nov. 14, 2014 in co-pending U.S. Appl. No. 13/318,369, now published as US Patent Application Publication No. US 2012/0043119.
Office Action mailed Aug. 26, 2014 in co-pending U.S. Appl. No. 13/318,382, now published as US Patent Application Publication No. US 2012/0043130.
Amendment and Response and Terminal Disclaimer filed Nov. 14, 2014 in co-pending U.S. Appl. No. 13/318,382, now published as US Patent Application Publication No. US 2012/0043130.
Restriction Requirement mailed Sep. 26, 2013 in co-pending U.S. Appl. No. 13/319,120 now published as US Patent Application Publication No. US 2012/0061851.
Response to Restriction Requirement filed Oct. 8, 2013 in co-pending U.S. Appl. No. 13/319,120 now published as US Patent Application Publication No. US 2012/0061851.
Notice of Non-Compliant Amendment mailed Oct. 15, 2013 in co-pending U.S. Appl. No. 13/319,120 now published as US Patent Application Publication No. US 2012/0061851.
Response to Restriction Requirement filed Oct. 18, 2013 in co-pending U.S. Appl. No. 13/319,120 now published as US Patent Application Publication No. US 2012/0061851.
Office Action mailed Jan. 17, 2014 in co-pending U.S. Appl. No. 13/319,120 now published as US Patent Application Publication No. US 2012/0061851.
Amendment and Response filed Apr. 16, 2014 in co-pending U.S. Appl. No. 13/319,120 now published as US Patent Application Publication No. US 2012/0061851.
Final Office Action mailed Jul. 31, 2014 in co-pending U.S. Appl. No. 13/319,120 now published as US Patent Application Publication No. US 2012/0061851.
Applicant-Initiated Interview Summary mailed Sep. 12, 2014 in co-pending U.S. Appl. No. 13/319,120 now published as US Patent Application Publication No. US 2012/0061851.
Amendment and Response and RCE filed Oct. 1, 2014 in co-pending U.S. Appl. No. 13/319,120 now published as US Patent Application Publication No. US 2012/0061851.
Notice of Allowance and Fee(s) Due mailed Oct. 27, 2014 in co-pending U.S. Appl. No. 13/319,120 now published as US Patent Application Publication No. US 2012/0061851.
Restriction Requirement mailed Jan. 30, 2014 in co-pending U.S. Appl. No. 13/319,158, now published as US Patent Application Publication No. 2012/0051016.
Response to Restriction Requirement filed Feb. 6, 2014 in co-pending U.S. Appl. No. 13/319,158, now published as US Patent Application Publication No. 2012/0051016.

(56) References Cited

OTHER PUBLICATIONS

Office Action mailed Jun. 27, 2014 in co-pending U.S. Appl. No. 13/319,158, now published as US Patent Application Publication No. 2012/0051016.
Amendment and Response filed Sep. 3, 2014 in co-pending U.S. Appl. No. 13/319,158, now published as US Patent Application Publication No. 2012/0051016.
Final Office Action mailed Nov. 6, 2014 in co-pending U.S. Appl. No. 13/319,158, now published as US Patent Application Publication No. 2012/0051016.
Amendment and Response Under Rule 1.116 and Request After Final Consideration Program 2.0 filed Dec. 18, 2014 in co-pending U.S. Appl. No. 13/319,158, now published as US Patent Application Publication No. 2012/0051016.
Advisory Action mailed Jan. 2, 2015 in co-pending U.S. Appl. No. 13/319,158, now published as US Patent Application Publication No. 2012/0051016.
Office Action mailed Feb. 27, 2014 in co-pending U.S. Appl. No. 13/319,203, now published as US Patent Application Publication No. 2012/0056640.
Amendment and Response filed Jun. 10, 2014 in co-pending U.S. Appl. No. 13/319,203, now published as US Patent Application Publication No. 2012/0056640.
Final Office Action mailed Aug. 20, 2014 in co-pending U.S. Appl. No. 13/319,203, now published as US Patent Application Publication No. 2012/0056640.
Amendment and Response Under Rule 1.116 filed Oct. 2, 2014 in co-pending U.S. Appl. No. 13/319,203, now published as US Patent Application Publication No. 2012/0056640.
Applicant-Initiated Interview Summary mailed Oct. 9, 2014 in co-pending U.S. Appl. No. 13/319,203, now published as US Patent Application Publication No. 2012/0056640.
Advisory Action mailed Oct. 16, 2014 in co-pending U.S. Appl. No. 13/319,203, now published as US Patent Application Publication No. 2012/0056640.
Request for Continued Examination filed Nov. 12, 2014 in co-pending U.S. Appl. No. 13/319,203, now published as US Patent Application Publication No. 2012/0056640.
Notice of Allowance and Fee(s) Due mailed Dec. 10, 2014 in co-pending U.S. Appl. No. 13/319,203, now published as US Patent Application Publication No. 2012/0056640.
Response to Restriction Requirement filed Oct. 4, 2013 in co-pending U.S. Appl. No. 13/266,573, now published as US Patent Application Publication No. 2012/0061846.
Office Action mailed Feb. 21, 2014 in co-pending U.S. Appl. No. 13/266,573, now published as US Patent Application Publication No. 2012/0061846.
Amendment and Response filed Feb. 26, 2014 in co-pending U.S. Appl. No. 13/266,573, now published as US Patent Application Publication No. 2012/0061846.
Office Action mailed Jul. 3, 2014 in co-pending U.S. Appl. No. 13/266,573, now published as US Patent Application Publication No. 2012/0061846.
Amendment and Response filed Sep. 9, 2014 in co-pending U.S. Appl. No. 13/266,573, now published as US Patent Application Publication No. 2012/0061846.
Examiner-Initiated Interview Summary mailed Mar. 14, 2013 in co-pending U.S. Appl. No. 13/319,228, now published as US Patent Application Publication No. US 2012/0058653.
Restriction Requirement mailed Apr. 23, 2014 in co-pending U.S. Appl. No. 13/319,228, now published as US Patent Application Publication No. US 2012/0058653.
Response to Restriction Requirement filed Jun. 23, 2014 in co-pending U.S. Appl. No. 13/319,228, now published as US Patent Application Publication No. US 2012/0058653.
Office Action mailed Sep. 4, 2014 in co-pending U.S. Appl. No. 13/319,228, now published as US Patent Application Publication No. US 2012/0058653.
Amendment and Response and Terminal Disclaimer filed Nov. 17, 2014 in co-pending U.S. Appl. No. 13/319,228, now published as US Patent Application Publication No. US 2012/0058653.
Notice of Allowance and Fee(s) Due mailed Jan. 13, 2015 in co-pending U.S. Appl. No. 13/319,228, now published as US Patent Application Publication No. US 2012/0058653.
Restriction Requirement mailed Feb. 7, 2014 in co-pending U.S. Appl. No. 13/575,368, now published as US Patent Application Publication No. 2013/0203273.
Response to Restriction Requirement filed Feb. 19, 2014 in co-pending U.S. Appl. No. 13/575,368, now published as US Patent Application Publication No. 2013/0203273.
Office Action mailed Mar. 4, 2014 in co-pending U.S. Appl. No. 13/575,368, now published as US Patent Application Publication No. 2013/0203273.
Notice of Abandonment mailed Oct. 10, 2014 in co-pending U.S. Appl. No. 13/575,368, now published as US Patent Application Publication No. 2013/0203273.
Office Action mailed Sep. 17, 2014 in co-pending U.S. Appl. No. 13/643,436, now published as US Patent Application Publication No. 2013/0105984.
Amendment and Response filed Nov. 19, 2014 in co-pending U.S. Appl. No. 13/643,436, now published as US Patent Application Publication No. 2013/0105984.
Office Action mailed Apr. 24, 2014 in co-pending U.S. Appl. No. 13/700,639, now published as US Patent Application Publication No. 2013/0078860.
Amendment and Response filed Jul. 30, 2014 in co-pending U.S. Appl. No. 13/700,639, now published as US Patent Application Publication No. 2013/0078860.
Final Office Action mailed Sep. 8, 2014 in co-pending U.S. Appl. No. 13/700,639, now published as US Patent Application Publication No. 2013/0078860.
Response Under Rule 1.116 filed Nov. 11, 2014 in co-pending U.S. Appl. No. 13/700,639, now published as US Patent Application Publication No. 2013/0078860.
Advisory Action mailed Dec. 3, 2014 in co-pending U.S. Appl. No. 13/700,639, now published as US Patent Application Publication No. 2013/0078860.
Amendment and Response and RCE filed Dec. 30, 2014 in co-pending U.S. Appl. No. 13/700,639, now published as US Patent Application Publication No. 2013/0078860.
Restriction Requirement mailed Jun. 5, 2014 in co-pending U.S. Appl. No. 13/879,783, now published as US Patent Application Publication No. 2013/0223034.
Response to Restriction Requirement filed Jul. 17, 2014 in co-pending U.S. Appl. No. 13/879,783, now published as US Patent Application Publication No. 2013/0223034.
Office Action mailed Oct. 6, 2014 in co-pending U.S. Appl. No. 13/879,783, now published as US Patent Application Publication No. 2013/0223034.
Office Action mailed Nov. 17, 2014 in co-pending U.S. Appl. No. 13/879,883, now published as US Patent Application Publication No. 2013/0244490.
Restriction Requirement mailed Sep. 9, 2013 in co-pending U.S. Appl. No. 13/410,914, now published as US Patent Application Publication No. US 2012/0164888.
Response to Restriction Requirement and Amendment to the Claims filed Sep. 25, 2013 in co-pending U.S. Appl. No. 13/410,914, now published as US Patent Application Publication No. US 2012/0164888.
Office Action mailed Dec. 16, 2013 in co-pending U.S. Appl. No. 13/410,914, now published as US Patent Application Publication No. US 2012/0164888.
Amendment and Response filed Mar. 17, 2014 in co-pending U.S. Appl. No. 13/410,914, now published as US Patent Application Publication No. US 2012/0164888.
Final Office Action mailed Jun. 4, 2014 in co-pending U.S. Appl. No. 13/410,914, now published as US Patent Application Publication No. US 2012/0164888.
Amendment and Response Under Rule 1.116 filed Jul. 29, 2014 in co-pending U.S. Appl. No. 13/410,914, now published as US Patent Application Publication No. US 2012/0164888.

(56) References Cited

OTHER PUBLICATIONS

Advisory Action mailed Aug. 12, 2014 in co-pending U.S. Appl. No. 13/410,914, now published as US Patent Application Publication No. US 2012/0164888.
Amendment and Response and RCE filed Sep. 30, 2014 in co-pending U.S. Appl. No. 13/410,914, now published as US Patent Application Publication No. US 2012/0164888.
Office Action mailed Dec. 26, 2014 in co-pending U.S. Appl. No. 13/410,914, now published as US Patent Application Publication No. US 2012/0164888.
Restriction Requirement mailed Jul. 31, 2014 in co-pending U.S. Appl. No. 13/410,943, now published as US Patent Application Publication No. US 2012/0161317.
Response to Restriction Requirement filed Aug. 19, 2014 in co-pending U.S. Appl. No. 13/410,943, now published as US Patent Application Publication No. US 2012/0161317.
Office Action mailed Nov. 7, 2013 in co-pending U.S. Appl. No. 13/412,870, now published as US Patent Application Publication No. US 2012/0171907.
Amendment and Response filed Dec. 10, 2013 in co-pending U.S. Appl. No. 13/412,870, now published as US Patent Application Publication No. US 2012/0171907.
Notice of Allowance and Fee(s) Due mailed Feb. 26, 2014 in co-pending U.S. Appl. No. 13/412,870, now published as US Patent Application Publication No. US 2012/0171907.
Restriction Requirement mailed Nov. 19, 2014 in co-pending U.S. Appl. No. 13/413,032, now published as US Patent Application Publication No. US 2012/0182035.
Response to Restriction Requirement filed Nov. 20, 2014 in co-pending U.S. Appl. No. 13/413,032, now published as US Patent Application Publication No. US 2012/0182035.
Notice of Allowance and Fee(s) Due mailed Jan. 5, 2015 in co-pending U.S. Appl. No. 13/413,032, now published as US Patent Application Publication No. US 2012/0182035.
Office Action mailed Apr. 30, 2013 in co-pending U.S. Appl. No. 13/413,724, now published as US Patent Application Publication No. US 2012/0168948.
Amendment and Response filed May 7, 2013 in co-pending U.S. Appl. No. 13/413,724, now published as US Patent Application Publication No. US 2012/0168948.
Notice of Non-Compliant Amendment mailed May 16, 2013 in co-pending U.S. Appl. No. 13/413,724, now published as US Patent Application Publication No. US 2012/0168948.
Revised Amendment and Response filed May 17, 2013 in co-pending U.S. Appl. No. 13/413,724, now published as US Patent Application Publication No. US 2012/0168948.
Office Action mailed Sep. 16, 2013 in co-pending U.S. Appl. No. 13/413,724, now published as US Patent Application Publication No. US 2012/0168948.
Amendment and Response filed Nov. 20, 2013 in co-pending U.S. Appl. No. 13/413,724, now published as US Patent Application Publication No. US 2012/0168948.
Final Office Action mailed Feb. 14, 2014 in co-pending U.S. Appl. No. 13/413,724, now published as US Patent Application Publication No. US 2012/0168948.
Amendment and Response to Final Office filed Feb. 26, 2014 in co-pending U.S. Appl. No. 13/413,724, now published as US Patent Application Publication No. US 2012/0168948.
Advisory Action mailed Mar. 28, 2014 in co-pending U.S. Appl. No. 13/413,724, now published as US Patent Application Publication No. US 2012/0168948.
Second Amendment and Response filed Apr. 14, 2014 in co-pending U.S. Appl. No. 13/413,724, now published as US Patent Application Publication No. US 2012/0168948.
Notice of Allowance and Fee(s) Due mailed May 9, 2014 in co-pending U.S. Appl. No. 13/413,724, now published as US Patent Application Publication No. US 2012/0168948.
Restriction Requirement mailed Apr. 10, 2014 in co-pending U.S. Appl. No. 13/418,853, now published as US Patent Application Publication No. US 2012/0244728.
Response to Restriction Requirement filed Apr. 23, 2014 in co-pending U.S. Appl. No. 13/418,853, now published as US Patent Application Publication No. US 2012/0244728.
Office Action mailed Jun. 26, 2014 in co-pending U.S. Appl. No. 13/418,853, now published as US Patent Application Publication No. US 2012/0244728.
Amendment and Response filed Aug. 26, 2014 in co-pending U.S. Appl. No. 13/418,853, now published as US Patent Application Publication No. US 2012/0244728.
Final Office Action mailed Oct. 28, 2014 in co-pending U.S. Appl. No. 13/418,853, now published as US Patent Application Publication No. US 2012/0244728.
Notice of Allowance and Fee(s) Due mailed Oct. 2, 2013 in co-pending U.S. Appl. No. 13/448,865, now published as US Patent Application Publication No. US 2012/0199985.
Notice of Allowance and Fee(s) Due mailed Dec. 6, 2013 in co-pending U.S. Appl. No. 14/058,863, now published as US Patent Application Publication No. 2014/0043782.
Office Action mailed Mar. 20, 2014 in co-pending U.S. Appl. No. 14/058,863, now published as US Patent Application Publication No. 2014/0043782.
Office Action mailed Mar. 27, 2014 in co-pending U.S. Appl. No. 14/058,863, now published as US Patent Application Publication No. 2014/0043782.
Response and Terminal Disclaimer filed Apr. 2, 2014 in co-pending U.S. Appl. No. 14/058,863, now published as US Patent Application Publication No. 2014/0043782.
Notice of Allowance and Fee(s) Due mailed Apr. 17, 2014 in co-pending U.S. Appl. No. 14/058,863, now published as US Patent Application Publication No. 2014/0043782.
Office Action mailed May 9, 2013 in co-pending U.S. Appl. No. 13/448,914, now published as US Patent Application Publication No. US 2012/0202364.
Amendment and Response filed May 20, 2013 in co-pending U.S. Appl. No. 13/448,914, now published as US Patent Application Publication No. US 2012/0202364.
Notice of Allowance and Fee(s) Due mailed Jul. 28, 2013 in co-pending U.S. Appl. No. 13/448,914, now published as US Patent Application Publication No. US 2012/0202364.
Office Action mailed Oct. 7, 2013 in co-pending U.S. Appl. No. 13/969,953, now issued as U.S. Pat. No. 8,704,377.
Amendment and Response and Terminal Disclaimer filed Nov. 20, 2013 in co-pending U.S. Appl. No. 13/969,953, now issued as U.S. Pat. No. 8,704,377.
Final Office Action mailed Dec. 20, 2013 in co-pending U.S. Appl. No. 13/969,953, now issued as U.S. Pat. No. 8,704,377.
Amendment and Response to Final Office filed Dec. 30, 2013 in co-pending U.S. Appl. No. 13/969,953, now issued as U.S. Pat. No. 8,704,377.
Notice of Allowance and Fee(s) Due mailed Jan. 22, 2014 in co-pending U.S. Appl. No. 13/969,953, now issued as U.S. Pat. No. 8,704,377.
Co-pending U.S. Appl. No. 14/327,916 titled Matrix Defined Electrical Circuit Structure, filed Jul. 10, 2014.
Co-pending U.S. Appl. No. 14/408,039 titled High Speed Circuit Assembly With Integral Terminal and Mating Bias Loading Electrical Connector Assembly, filed Dec. 15, 2014.
Co-pending U.S. Appl. No. 14/408,338 titled Semiconductor Socket With Direct Selective Metalization, filed Dec. 16, 2014.
Co-pending U.S. Appl. No. 14/565,724 titled Performance Enhanced Semiconductor Socket, filed Dec. 10, 2014.
Final Office Action mailed Mar. 16, 2015 in co-pending U.S. Appl. No. 13/320,285, now published as US Patent Application Publication No. US 2012/0055702.
Final Office Action mailed Feb. 10, 2015 in co-pending U.S. Appl. No. 13/318,382, now published as US Patent Application Publication No. US 2012/0043130.
Amendment and Response with RCE filed Feb. 5, 2015 in co-pending U.S. Appl. No. 13/319,158, now published as US Patent Application Publication No. 2012/0051016.
Notice of Allowance and Fee(s) Due mailed Feb. 9, 2015 in co-pending U.S. Appl. No. 13/643,436, now published as US Patent Application Publication No. 2013/0105984.

(56) References Cited

OTHER PUBLICATIONS

Restriction Requirement mailed Feb. 12, 2015 in co-pending U.S. Appl. No. 13/700,639, now published as US Patent Application Publication No. 2013/0078860.
Response to Restriction Requirement filed Feb. 24, 2015 in co-pending U.S. Appl. No. 13/700,639, now published as US Patent Application Publication No. 2013/0078860.
Amendment and Response filed Feb. 3, 2015 in co-pending U.S. Appl. No. 13/879,783, now published as US Patent Application Publication No. 2013/0223034.
Amendment and Response filed Mar. 10, 2015 in co-pending U.S. Appl. No. 13/879,883, now published as US Patent Application Publication No. 2013/0244490.
Restriction Requirement mailed Jan. 22, 2015 in co-pending U.S. Appl. No. 13/880,231, now published as US Patent Application Publication No. 2013/0210276.
Response to Restriction Requirement filed Jan. 27, 2015 in co-pending U.S. Appl. No. 13/880,231, now published as US Patent Application Publication No. 2013/0210276.
Office Action mailed Feb. 27, 2015 in co-pending U.S. Appl. No. 13/410,943, now published as US Patent Application Publication No. US 2012/0161317.
Amendment and Response with RCE filed Jan. 28, 2015 in co-pending U.S. Appl. No. 13/418,853, now published as US Patent Application Publication No. US 2012/0244728.
Office Action mailed Feb. 20, 2015 in co-pending U.S. Appl. No. 13/418,853, now published as US Patent Application Publication No. US 2012/0244728.
U.S. Appl. No. 14/621,663, filed Feb. 13, 2015, High Performance Surface Mount Electrical Interconnect.

* cited by examiner

HIGH PERFORMANCE SURFACE MOUNT ELECTRICAL INTERCONNECT

RELATED APPLICATIONS

The present application is a continuation of U.S. patent application Ser. No. 13/266,486, entitled High Performance Surface Mount Electrical Interconnect, filed Oct. 27, 2011 (Allowed), which claims the benefit of a national stage application under 35 U.S.C. §371 of International Application No. PCT/US2010/036043 entitled High Performance Surface Mount Electrical Interconnect, filed May 25, 2010, which claims the benefit of U.S. Provisional Application No. 61/181,937, entitled High Performance Surface Mount Electrical Interconnect, filed May 28, 2009.

TECHNICAL FIELD

The present application relates to a high performance electrical interconnect assembly between an integrated circuit and a printed circuit assembly.

BACKGROUND OF THE INVENTION

Traditional integrated circuit (IC) sockets are generally constructed of an injection molded plastic insulator housing which has stamped and formed copper alloy contact members stitched or inserted into designated positions within the housing. The designated positions in the insulator housing are typically shaped to accept and retain the contact members. The assembled socket body is then generally processed through a reflow oven which melts and attaches solder balls to the base of the contact member. During final assembly, the socket can be mounted onto a printed circuit assembly. The printed circuit assembly may be a printed circuit board (PCB), the desired interconnect positions on the PCB are printed with solder paste or flux and the socket is placed such that the solder balls on the socket contacts land onto the target pads on the PCB. The assembly is then reheated to reflow the solder balls on the socket assembly. When the solder cools it essentially welds the socket contacts to the PCB, creating the electrical path for signal and power interaction with the system.

During use, the socket receives one or more IC packages and connects each terminal on the IC package to the corresponding terminal on the PCB. The terminals on the IC package are held against the contact members by applying a load to the package, which is expected to maintain intimate contact and reliable circuit connection throughout the life of the system. No permanent connection is required so that the IC package can be removed or replaced without the need for reflowing solder connections.

These types of sockets and interconnects have been produced in high volume for many years. As systems advance to next generation architectures, these traditional devices have reached mechanical and electrical limitations that mandate alternate approaches.

As processors and electrical systems evolve, several factors have impacted the design of traditional sockets. Increased terminal count, reductions in the terminal pitch (i.e., the distance between the contacts), and signal integrity have been main drivers that impact the socket and contact design. As terminal count increases, the IC packages get larger due to the additional space needed for the terminals. As the IC package grows larger the relative flatness of the IC package and corresponding PCB becomes more important. A certain degree of compliance is required between the contacts and the terminal pads to accommodate the topography differences and maintain reliable connections.

IC package manufacturers tend to drive the terminal pitch smaller so they can reduce the size of the IC package and reduce the flatness effects. As the terminal pitch reduces, however, the surface area available to place a contact is also reduced, which limits the space available to locate a spring or a contact member that can deflect without touching a neighbor.

In order to maximize the length of the spring so that it can deflect the proper amount without damage, the thickness of the insulating walls within the plastic housing is reduced. Thinner walls increase the difficulty of molding as well as the latent stress in the molded housing that can cause warping due to heat applied during solder reflow.

For mechanical reasons, longer contact members traditionally have been preferred because they have desirable spring properties. Long contact members, however, tend to reduce the electrical performance of the connection by creating a parasitic effect that impacts the signal as it travels through the contact. Other factors, such as contact resistance, impact self heating as current passes through, for example, power delivery contacts. Also, the small space between contact members can cause distortion as a nearby contact member influences a neighboring contact member, which is known as cross talk.

Traditional sockets and methods of fabricating the same are able to meet the mechanical compliance requirements of today's needs, but they have reached an electrical performance limit. Next generation systems will operate above 5 GHz and beyond and the existing interconnects will not achieve acceptable performance levels without significant revision.

BRIEF SUMMARY OF THE INVENTION

The present disclosure is directed to electrical interconnects that enable next generation electrical performance. An electrical interconnect assembly according to the present disclosure may include a substrate and a plurality of discrete contact members positioned and secured in a plurality of holes through the substrate. Some of the embodiments can include a high performance interconnect architecture within a socket.

In one embodiment, the contact members can be simple beam structures made of conventional materials, but omit the normal retention features that add parasitic mass and distort or degrade the integrity of the signal as it passes through the contact member. This approach provides a reliable connection to the package terminals and creates a platform to add electrical and mechanical enhancements to the substrate of the socket to address the challenges of next generation interconnect requirements. The lack of contact member retention features greatly reduces the complexity of the contact members and the tooling required to produce them.

The substrate containing the contact members may be inverted to expose the proximal ends of the contact members that will electrically couple with the PCB. This surface of the substrate and the array of exposed proximal ends of the contact members may be processed to achieve contact retention, to add mechanical features to improve the reliability of the solder joint to the PCB, and to provide a platform to add passive and active circuit features to improve electrical performance or internal function and intelligence.

Once the substrate is loaded with contact members, the substrate can be processed as a printed circuit or semiconductor package to add functions and electrical enhancements not found in traditional connectors. In one embodiment, electrical features and devices are printed onto the substrate using, for example, inkjet printing technology, aerosol printing technology, or other printing technology. The ability to enhance the substrate such that it mimics aspects of the IC package and the PCB allows for reductions in complexity for the IC package and the PCB while improving the overall performance of the interconnect assembly.

The printing processes permits the fabrication of functional structures, such as conductive paths and electrical devices, without the use of masks or resists. Features down to about 10 microns can be directly written in a wide variety of functional inks, including metals, ceramics, polymers and adhesives, on virtually any substrate—silicon, glass, polymers, metals and ceramics. The substrates can be planar and non-planar surfaces. The printing process is typically followed by a thermal treatment, such as in a furnace or with a laser, to achieve dense functionalized structures.

The use of additive printing processes permits the material set in a given layer to vary. Traditional PCB and circuit fabrication methods take sheets of material and stack them up, laminate, and/or drill. The materials in each layer are limited to the materials in a particular sheet. Additive printing technologies permit a wide variety of materials to be applied on a layer with a registration relative to the features of the previous layer. Selective addition of conductive, non-conductive, or semi-conductive materials at precise locations to create a desired effect has the major advantages in tuning impedance or adding electrical function on a given layer. Tuning performance on a layer by layer basis relative to the previous layer can greatly enhance electrical performance.

The present method and apparatus can permit dramatic simplification of the contact members and the substrate of the socket housing. The preferably featureless contact members reduce parasitic effects of additional metal features normally present for contact member retention. The present method and apparatus can be compatible with existing high volume manufacturing techniques. Adding functions to the socket housing permits reductions in the cost and complexity of the IC package and/or the PCB.

In another embodiment, mechanical decoupling features are added to the contact member retention structure. The interconnect assembly can be configured to electrically and mechanically couple to contact pads on the PCB, thereby reducing cost and eliminating at least one reflow cycle that can warp or damage the substrate.

The interconnect assembly can be configured with conductive traces that reduce or redistribute the terminal pitch, without the addition of an interposer or daughter substrate. Grounding schemes, shielding, electrical devices, and power planes can be added to the interconnect assembly, reducing the number of connections to the PCB and relieving routing constraints while increasing performance.

Another embodiment of the interconnect assembly may include a substrate with a plurality of through holes extending from a first surface to a second surface. Pluralities of discrete contact members are positioned in the plurality of through holes. The contact members include proximal ends that are accessible from the second surface, distal ends extending above the first surface, and intermediate portions engaged with an engagement region of the substrate located between the first surface and the recesses. Retention members are coupled with a portion of the proximal ends to retain the contact members to the substrate.

In another embodiment, the substrate may include a plurality of recesses in the second surface that at least partially overlap with a plurality of the through holes. The recesses preferably have a cross-sectional area greater than a cross-sectional area of the through holes. The retention members can be located in the recesses. The substrate can be a single layer or a plurality of layers. The substrate may also include additional circuitry planes.

The retention members can be made from a variety of materials with different levels of conductivity, ranging from highly conductive to non-conductive. For example, a retention member can be solder, solder paste, a conductive plug, a conductive adhesive, or electrical plating.

In one embodiment, a layer of dielectric material is bonded to the first surface of the substrate. The layer preferably has a thickness less than a height of the distal ends of the contact members. The layer can be used to limit deflection of the distal end and to provide a barrier between adjacent contact members to prevent inadvertent contact.

In another embodiment, a plurality of conductive traces are located on at least one of the first and second surfaces of the substrate and electrically coupled to a plurality of the contact members. The conductive traces can have a pitch different than the pitch of the proximal ends of the contact members. A compliant layer can be positioned between one of the second surface and the conductive traces or between overlapping conductive traces. A flexible circuit member can be electrically coupled to the conductive traces and extend beyond a perimeter edge of the substrate to provide interconnection with other devices, such as for example a second interconnect assembly.

A plurality of electrical devices can be located on the substrate and electrically coupled to at least one contact member. The electrical devices may include, for example, a power plane, ground plane, capacitor, resistor, filters, signal or power altering and enhancing device, memory device, embedded integrated circuit, and RF antennae. In one embodiment, the electrical devices are printed on at least one of the first or second surface of the substrate. The electrical devices may be printed on the substrate using, for example, inkjet printing technology, aerosol printing technology, or other printing technology.

The present disclosure is also directed to an electrical assembly including contact pads on a first circuit member compressively engaged with distal ends of the contact members, and contact pads on a second circuit member bonded to one or more of the retention members or the proximal ends of the contact members. The first and second circuit members can be, for example, a dielectric layer, a printed circuit board, a flexible circuit, a bare die device, an integrated circuit device, organic or inorganic substrates, or a rigid circuit.

The present disclosure is also directed to a method of forming an interconnect assembly. A substrate may be provided with a plurality of through holes extending from a first surface to a second surface. A plurality of discrete contact members can be inserted in a plurality of the through holes. The contact members can include proximal ends that are accessible from the second surface, distal ends extending above the first surface, and intermediate portions engaged with an engagement region of the substrate located between the first surface and the recesses. A retention member is engaged with a plurality of the proximal ends to retain the contact members to the substrate. A plurality of recesses is optionally located in the second surface of the substrate that at least partially overlaps with a plurality of the through holes. The retention members can be located in the recesses.

DETAILED DESCRIPTION OF THE INVENTION

An interconnect assembly, according to the present disclosure, may permit fine contact-to-contact spacing (pitch) on the order of less than 1.0 millimeter ($1\times10^{-3}$ meter), and more preferably a pitch of less than about 0.7 millimeter, and most preferably a pitch of less than about 0.4 millimeter. Such fine pitch interconnect assemblies are especially useful for communications, wireless, and memory devices. The disclosed low cost, high signal performance interconnect assemblies, which have low profiles and can be soldered to the system PC board, are particularly useful for desktop and mobile PC applications.

The disclosed interconnect assemblies may permit IC devices to be installed and uninstalled without the need to reflow solder. The solder-free electrical connection of the IC devices is environmentally friendly.

Figure 1A:
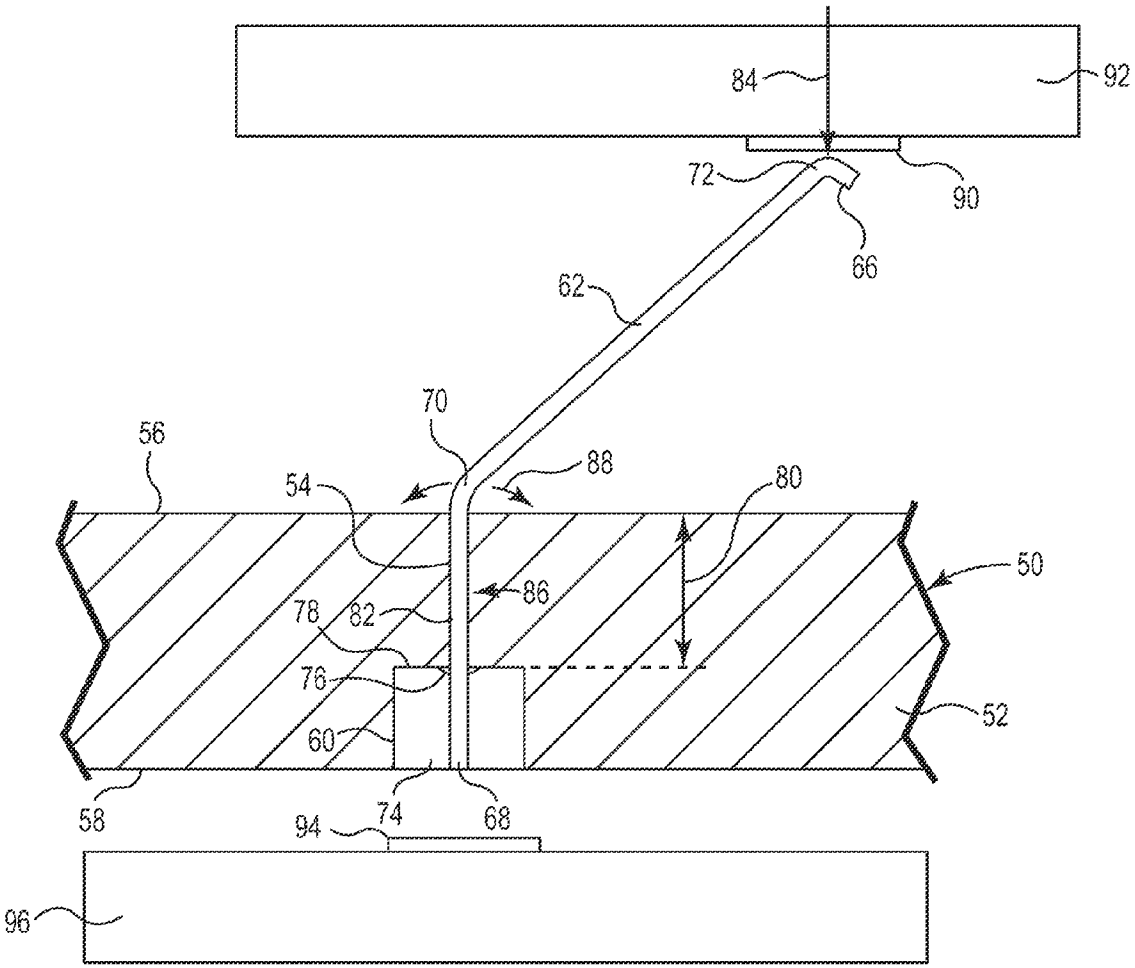
FIG. 1A is a cross-sectional view of an interconnect assembly in accordance with an embodiment of the present disclosure.

FIG. 1A is a side cross-sectional view of a portion of an interconnect assembly 50 in accordance with an embodiment of the present disclosure. A substrate 52 can include an array of through holes 54 that extend from a first surface 56 to a second surface 58. A recess 60 is formed in the second surface 58 that overlaps with the through hole 54. In one embodiment, the substrate 52 is the bottom of a socket housing adapted to receive an IC device. Although the substrate 52 is illustrated as a generally planar structure, an interconnect assembly according to the present disclosure may include one or more recesses for receiving IC devices and a cover assembly for retaining the IC devices to the substrate 52, such as disclosed in U.S. Pat. No. 7,101,210 (Lin et al.); U.S. Pat. No. 6,971,902 (Taylor et al.); U.S. Pat. No. 6,758,691 (McHugh et al.); U.S. Pat. No. 6,461,183 (Ohkita et al.); and U.S. Pat. No. 5,161,983 (Ohno et al.), which are hereby incorporated by reference.

The substrate 52 may be preferably constructed of any of a number of dielectric materials that are currently used to make sockets, semiconductor packaging, and PCBs. Examples may include UV stabilized tetrafunctional epoxy resin systems referred to as Flame Retardant 4 (FR-4); bismaleimide-triazine thermoset epoxy resins referred to as BT-Epoxy or BT Resin; and liquid crystal polymers (LCPs), which are polyester polymers that are extremely unreactive, inert and resistant to fire. Other suitable plastics include phenolics, polyesters, and Ryton® available from Phillips Petroleum Company.

The substrate 52 may also be constructed from metal, such as aluminum, copper, or alloys thereof, with a non-conductive surface, such as an anodized surface. In another embodiment, a metal substrate can be overmolded with a dielectric polymeric material. For example, a copper substrate may be placed in a mold and plastic may be injected around it.

In embodiments where the substrate 52 is a coated metal, the substrate 52 can be grounded to the electrical system, thus providing a controlled impedance environment. Some of the contact members 62 can be grounded by permitting them to contact an uncoated surface of the metal housing.

Figure 1B:
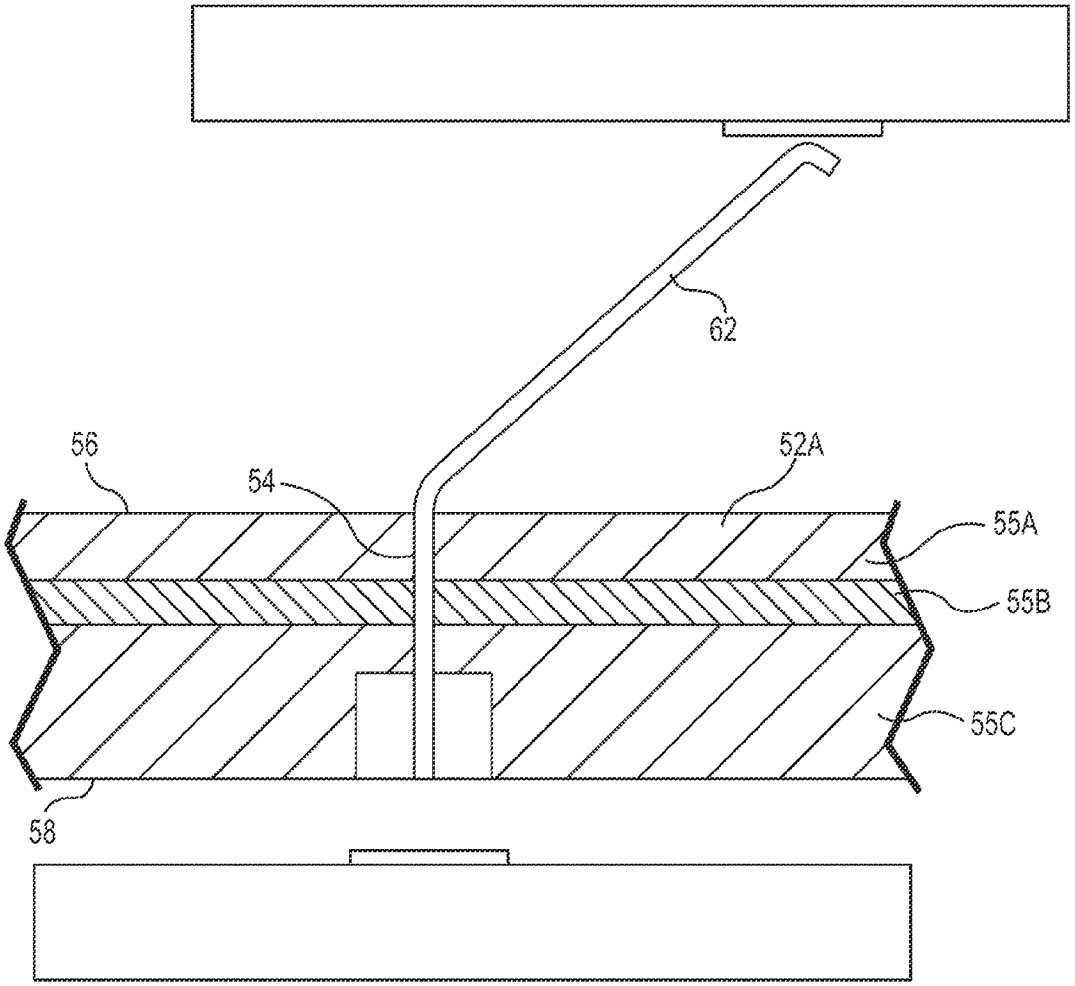
FIG. 1B is a cross-sectional view of an interconnect assembly with a multi-layered substrate in accordance with another embodiment of the present disclosure.

The substrate 52 may also include stiffening layers, such as metal, ceramic, or alternate filled resins, to be added to maintain flatness where a molded or machined part might warp. The substrate 52 may also be multi-layered (having a plurality of discrete layers), as shown in FIG. 1B and discussed below with reference to the same.

A plurality of discrete contact members 62 may be inserted into the through holes 54. In the illustrated embodiment, the contact members 62 are simple cantilever beams without any retention features. The contact members 62 preferably have a generally uniform cross section 64 from the distal end 66 to the proximal end 68. As used herein, "uniform contact member" refers to an elongate conductive element with a substantially uniform cross-sectional shape along its entire length. The cross-sectional shape can be rectangular, square, circular, triangular, or a variety of other shapes. In another embodiment, contact members 62 with a variety of features are inserted into the through holes 54 and processed as discussed herein. The contact members 62 are preferably constructed of copper or similar metallic materials such as phosphor bronze or beryllium-copper. The contact members are preferably plated with a corrosion resistant metallic material such as nickel, gold, silver, palladium, or multiple layers thereof. In some embodiments the contact members are encapsulated except the distal and proximal ends. Examples of suitable encapsulating materials include Sylgard® available from Dow Coming Silicone of Midland, Mich. and Master Sil 713 available from Master Bond Silicone of Hackensack, N.J. Suitable contact members are disclosed in U.S. Pat. No. 6,247,938 (Rathburn) and U.S. Pat. No. 6,461,183 (Ohkita et al.), which are hereby incorporated by reference.

The contact members 62 can be deposited into the through holes 54 using a variety of techniques, such as for example stitching or vibratory techniques. In one embodiment, the contact members 62 are press-fit into the through holes 54. A post insertion solder mask (as done on PCBs and IC packages) can also be added to the recesses 60 to improve solder deposit formation and wick prevention.

In one embodiment, a bend 70 limits the depth of insertion of the contact members 62 into the substrate 52 and fixes the location of a proximal end 68 relative to the second surface 58. The bend 70 also permits a distal end 66 to flex when coupled to contact pad 90 on first circuit member 92. In one embodiment, distal ends 66 of the contact members 62 are held in a fixture until proximal ends 68 are secured to the substrate 52 by a retention member 74.

An intermediate portion 82 of the contact member 62 is engaged with an engagement region 86 of the substrate 52 located between the first surface 56 and the recess 60. In one embodiment, the intermediate portion 82 forms a friction fit with the engagement region 86. Thickness 80 of the engagement region 86 provides sufficient surface area to limit rotation of the contact member 62 relative to the substrate 52 in any direction, including rotation 88 about the longitudinal access of the intermediate portion 82. In a preferred embodiment, the engagement region 86 of the substrate 52 limits rotation 88 to less than about 1 degree to about 3 degrees, and more preferably less than about 0.5 degrees.

The surface area of the engagement region 86 is preferably sufficient to counteract a force 84 applied to proximal end 66, without leading to plastic deformation of the contact member 62. The surface area of the engagement region 86 between the proximal end 68 and the through hole 54 also provides friction that aids in retaining the contact member 54 in the substrate 52.

A bend 72 near distal end 66 is optionally provided to enhance coupling with the contact pads 90 on the first circuit member 92. The contact members 62 may have a variety of shapes, such as reversing the bend 72 or basic vertical structures. Proximal end 68 can be electrically coupled to contact pads 94 on a second circuit member 96 using a variety of techniques, including solder, pressure, and the like. As used herein, the term "circuit member" refers to, for example, a packaged integrated circuit device, an unpackaged integrated circuit device, a printed circuit board, a flexible circuit, a bare-die device, an organic or inorganic substrate, a rigid circuit, or any other device capable of carrying electrical current.

With contact members 62 inserted, the substrate 52 is inverted to expose the proximal ends 68 located within the recess 60. The proximal ends 68, the recesses 60 and the second surface 58 can then be subjected to additional processing as discussed in the various embodiments detailed below. In one embodiment, the force 84 is applied to the contact members 62 during subsequent processing so as to minimize stresses in the assembly during engagement with IC 92. In these subsequent embodiments, the substrate 52 and contact member 62 are generally configured as discussed in connection with FIG. 1A, although some variation may occur to accommodate certain aspects of the particular embodiment.

In the embodiment of FIG. 1A, retention member 74 is formed in the recess 60 to provide contact retention and as a solder attachment point that will control the wetting region of the molten solder. In one embodiment, the recesses 60 are substantially filled with a conductive material, such as for example, solder, solder paste, a conductive plug, conductive adhesive, or conductive plating. In another embodiment, the retention member 74 is a mixture including conductive particles that are sintered in situ within the recess 60.

The retention member 74 is preferably conductive and preferably bonds well to solder. In another embodiment, the retention member 74 can be made from a variety of materials with different levels of conductivity, ranging from highly conductive to non-conductive.

The retention member 74 is optionally deposited in the recesses 60 before the contact members 62 are inserted into the substrate 52. The contact members 62 are plugged into the retention member 74. The retention member 74 preferably has sufficient adhesive properties to retain the contact members 62 in the substrate 52 during subsequent processing.

In yet another embodiment, the retention member 74 is formed from a conductive ink, which can be optionally deposited into the recesses 60 using various printing technologies, such as for example inkjet printing technology, aerosol printing technology, or other printing technology. A printer may deposit droplets of ink (e.g. material) using, for example a printing head.

The availability of printable silicon inks provides the ability to print electrical devices and features, such as disclosed in U.S. Pat. No. 7,485,345 (Renn et al.); U.S. Pat. No. 7,382,363 (Albert et al.); U.S. Pat. No. 7,148,128 (Jacobson); U.S. Pat. No. 6,967,640 (Albert et al.); U.S. Pat. No. 6,825,829 (Albert et al.); U.S. Pat. No. 6,750,473 (Amundson et al.); U.S. Pat. No. 6,652,075 (Jacobson); U.S. Pat. No. 6,639,578 (Comiskey et al.); U.S. Pat. No. 6,545,291 (Amundson et al.); U.S. Pat. No. 6,521,489 (Duthaler et al.); U.S. Pat. No. 6,459,418 (Comiskey et al.); U.S. Pat. No. 6,422,687 (Jacobson); U.S. Pat. No. 6,413,790 (Duthaler et al.); U.S. Pat. No. 6,312,971 (Amundson et al.); U.S. Pat. No. 6,252,564 (Albert et al.); U.S. Pat. No. 6,177,921 (Comiskey et al.); U.S. Pat. No. 6,120,588 (Jacobson); U.S. Pat. No. 6,118,426 (Albert et al.); and U.S. Pat. Publication No. U.S. Pat. No. 2008/0008822 (Kowalski et al.), which are hereby incorporated by reference.

Various methods for maskless deposition of electronic materials and forming electrical devices and features may also be used, such as disclosed in U.S. Pat. No. 7,485,345 (Renn et al.); U.S. Pat. No. 6,825,829 (Albert at al.); and U.S. Pat. Publication No. 2008/0008822 (Kowalski et al.), which are hereby incorporated by reference. Inkjet printing technology, aerosol printing technology, and other printing technologies are examples of maskless deposition which can be used to deposit material to form electrical devices and features.

Printing processes are preferably used to fabricate various functional structures, such as conductive paths and electrical devices, without the use of masks or resists. Features down to about 10 microns can be directly written in a wide variety of functional inks, including metals, ceramics, polymers and adhesives, on virtually any substrate—silicon, glass, polymers, metals and ceramics. The substrates can be planar and non-planar surfaces. The printing process is typically followed by a thermal treatment, such as in a furnace or with a laser, to achieve dense functionalized structures.

U.S. Pat. No. 6,506,438 (Duthaler et al.) and U.S. Pat. No. 6,750,473 (Amundson et al.), which are hereby incorporated by reference, teach using inkjet printing to make various electrical devices, such as, resistors, capacitors, diodes, inductors (or elements which may be used in radio applications or magnetic or electric field transmission of power or data), semiconductor logic elements, electro-optical elements, transistor (including, light emitting, light sensing or solar cell elements, field effect transistor, top gate structures), and the like.

U.S. Pat. No. 7,674,671 (Renn et al.); U.S. Pat. No. 7,658,163 (Renn et al.); U.S. Pat. No. 7,485,345 (Renn et al.); U.S. Pat. No. 7,045,015 (Renn et al.); and U.S. Pat. No. 6,823,124 (Renn et al.), which are hereby incorporated by reference, teach using aerosol printing to create various electrical devices and features.

Printing of electronically active inks can be done on a large class of substrates, without the requirements of standard vacuum processing or etching. The inks may incorporate mechanical, electrical or other properties, such as, conducting, insulating, resistive, magnetic, semiconductive, light modulating, piezoelectric, spin, optoelectronic, thermoelectric or radio frequency.

A plurality of ink drops are dispensed from the print head directly to a substrate or on an intermediate transfer member. The transfer member can be a planar or non-planar structure, such as a drum. The surface of the transfer member can be coated with a non-sticking layer, such as silicone, silicone rubber, or teflon.

The ink (also referred to as function inks) can include conductive materials, semi-conductive materials (e.g., p-type and n-type semiconducting materials), metallic material, insulating materials, and/or release materials. The ink pattern can be deposited in precise locations on a substrate to create fine lines having a width smaller than 10 microns, with precisely controlled spaces between the lines. For example, the ink drops form an ink pattern corresponding to portions of a transistor, such as a source electrode, a drain electrode, a dielectric layer, a semiconductor layer, or a gate electrode.

The substrate can be an insulating polymer, such as polyethylene terephthalate (PET), polyester, polyethersulphone (PES), polyimide film (e.g. Kapton, available from Dupont located in Wilminton, Del.; Upilex available from Ube Corporation located in Japan), or polycarbonate. Alternatively, the substrate can be made of an insulator such as undoped silicon, glass, or a plastic material. The substrate can also be patterned to serve as an electrode. The substrate can further be a metal foil insulated from the gate electrode by a non-conducting material. The substrate can also be a woven material or paper, planarized or otherwise modified on at least one surface by a polymeric or other coating to accept the other structures.

Electrodes can be printed with metals, such as aluminum or gold, or conductive polymers, such as polythiophene or polyaniline. The electrodes may also include a printed conductor, such as a polymer film comprising metal particles, such as silver or nickel, a printed conductor comprising a polymer film containing graphite or some other conductive carbon material, or a conductive oxide such as tin oxide or indium tin oxide.

Dielectric layers can be printed with a silicon dioxide layer, an insulating polymer, such as polyimide and its derivatives, poly-vinyl phenol, polymethylmethacrylate, polyvinyldenedifluoride, an inorganic oxide, such as metal oxide, an inorganic nitride such as silicon nitride, or an inorganic/organic composite material such as an organic-substituted silicon oxide, or a sol-gel organosilicon glass. Dielectric layers can also include a bicylcobutene derivative (BCB) available from Dow Chemical (Midland, Mich.), spin-on glass, or dispersions of dielectric colloid materials in a binder or solvent.

Semiconductor layers can be printed with polymeric semiconductors, such as, polythiophene, poly(3-alkyl)thiophenes, alkyl-substituted oligothiophene, polythienylenevinylene, poly(para-phenylenevinylene) and doped versions of these polymers. An example of suitable oligomeric semiconductor is alpha-hexathienylene. Horowitz, Organic Field-Effect Transistors, Adv. Mater., 10, No. 5, p. 365 (1998) describes the use of unsubstituted and alkyl-substituted oligothiophenes in transistors. A field effect transistor made with regioregular poly(3-hexylthiophene) as the semiconductor layer is described in Bao et al., Soluble and Processable Regioregular Poly(3-hexylthiophene) for Thin Film Field-Effect Transistor Applications with High Mobility, Appl. Phys. Lett. 69 (26), p. 4108 (December 1996). A field effect transistor made with a-hexathienylene is described in U.S. Pat. No. 5,659,181 (Bridenbaugh et al.), which is incorporated herein by reference.

A protective layer can optionally be printed onto the electrical devices and features. The protective layer can be an aluminum film, a metal oxide coating, a polymeric film, or a combination thereof.

Organic semiconductors can be printed using suitable carbon-based compounds, such as, pentacene, phthalocyanine, benzodithiophene, buckminsterfullerene or other fullerene derivatives, tetracyanonaphthoquinone, and tetrakisimethylanimoethylene. The materials provided above for forming the substrate, the dielectric layer, the electrodes, or the semiconductor layer are exemplary only. Other suitable materials known to those skilled in the art having properties similar to those described above can be used in accordance with the present invention.

An inkjet print head, or other print head, preferably includes a plurality of orifices for dispensing one or more fluids onto a desired media, such as for example, a conducting fluid solution, a semiconducting fluid solution, an insulating fluid solution, and a precursor material to facilitate subsequent deposition. The precursor material can be surface active agents, such as octadecyltrichlorosilane (OTS).

Alternatively, a separate print head can be used for each fluid solution. The print head nozzles can be held at different potentials to aid in atomization and imparting a charge to the droplets, such as disclosed in U.S. Pat. No. 7,148,128

(Jacobson), which is hereby incorporated by reference. Alternate print heads are disclosed in U.S. Pat. No. 6,626,526 (Ueki et al.), and U.S. Pat. Publication Nos. 2006/0044357 (Andersen et al.) and 2009/0061089 (King et al.), which are hereby incorporated by reference.

The print head preferably uses a pulse-on-demand method, and can employ one of the following methods to dispense the ink drops: piezoelectric, magnetostrictive, electromechanical, electropneumatic, electrostatic, rapid ink heating, magnetohydrodynamic, or any other technique well known to those skilled in the art. The deposited ink patterns typically undergo a curing step or another processing step before subsequent layers are applied.

The use of additive printing processes permits the material set in a given layer to vary. Traditional PCB and circuit fabrication methods take sheets of material and stack them up, laminate, and/or drill. The materials in each layer are limited to the materials in a particular sheet. Additive printing technologies permit a wide variety of materials to be applied on a layer with a registration relative to the features of the previous layer. Selective addition of conductive, non-conductive, or semi-conductive materials at precise locations to create a desired effect has the major advantages in tuning impedance or adding electrical function on a given layer. Tuning performance on a layer by layer basis relative to the previous layer greatly enhances electrical performance.

While inkjet printing is preferred, the term "printing" is intended to include all forms of printing and coating, including: premetered coating such as patch die coating, slot or extrusion coating, slide or cascade coating, and curtain coating; roll coating such as knife over roll coating, forward and reverse roll coating; gravure coating; dip coating; spray coating; meniscus coating; spin coating; brush coating; air knife coating; screen printing processes; electrostatic printing processes; thermal printing processes; aerosol printing processes; and other similar techniques.

With each pass of the printing heads, additional ink is applied at a desired location on substrate 52, in this case in recess 60. In other embodiments, other components of the interconnect assembly 50 may be applied using printing technology, such as for example inkjet printing technology, aerosol printing technology, or other printing technology, including three-dimensional components extending away or above the first and second surfaces 56, 58. In such cases, the substrate 52 may rest or be secured to a base during the printing process. With each pass of the printing heads, the base on which the substrate 52 rests moves down a notch. In this way, little by little the component takes shape. Components may also be printed on a removable "scaffold," which provides support and/or a desired component shape. In some embodiments the conductive ink is subsequently sintered.

In another embodiment, a sealing material 76 is applied to the intersection of the base 78 of the retention member 74 with the proximal end 68 to prevent solder from wicking along the contact members 62. The sealing member 76 may also be a mechanism for retaining the contact member 62 to the substrate 52. The sealing member 76 may be deposited using various printing technologies, including inkjet printing technology, aerosol printing technology, or other printing technology as was previously described.

In another embodiment, the portion of the contact members 62 located above and below the surfaces 56, 58 can be bent, peened, coined or otherwise plastically deformed during or after insertion into the substrate 52. For example, proximal end 68 can be plastically deformed to retain the contact member 62 in the substrate 52.

Subsequent processing of the various interconnect assemblies disclosed herein can be done with conventional techniques, such as for example screen printing for features larger than about 100 micrometers and thin film and etching methods for features smaller than about 100 micrometers. Other subtractive methods to attain fine feature sizes include the use of photo-patternable pastes and laser trimming.

FIG. 1B is a cross-sectional view of an interconnect assembly with a multi-layered substrate 52A including a plurality of discrete layers 55A, 55B, 55C (collectively "55"). The layers 55 can be etched or ablated and stacked without the need for expensive mold tooling. The layers 55 can create features that have a much larger aspect ratio than typically possible with molding or machining. The layers 55 also permit the creation of internal features, undercuts, or cavities that are difficult or typically not possible to make using conventional molding or machining techniques, referred to herein as a "non-moldable feature." The substrate 52A may also permit stiffening layers, such as metal, ceramic, or alternate filled resins, to be added to maintain flatness where a molded or machined part might warp. The layers 55 can be selectively bonded or non-bonded to provide contiguous material or releasable layers. As used herein, "bond" or "bonding" refers to, for example, adhesive bonding, solvent bonding, ultrasonic welding, thermal bonding, or any other techniques suitable for attaching adjacent layers of the housing.

One of the layers 55 can optionally be an additional circuitry plane, such as for example a ground plane, a power plane, an electrical connection to other circuit members, a dielectric layer, a printed circuit board, a flexible circuit, a bare die device, an integrated circuit device, organic or inorganic substrates, or a rigid circuit. The additional circuitry plane can also be formed on one of the surfaces 56, 58. In another embodiment, one of the layers 55 can be a high friction material that aids in retaining contact members 62 in the through hole 54. As previously described, the use of additive printing processes permits a wide variety of materials to be applied on a layer with a registration relative to the features of the previous layer. Selective addition of conductive, non-conductive, or semi-conductive materials at precise locations to create a desired effect can offer a variety of advantages and can improve electrical performance.

Figure 1C:
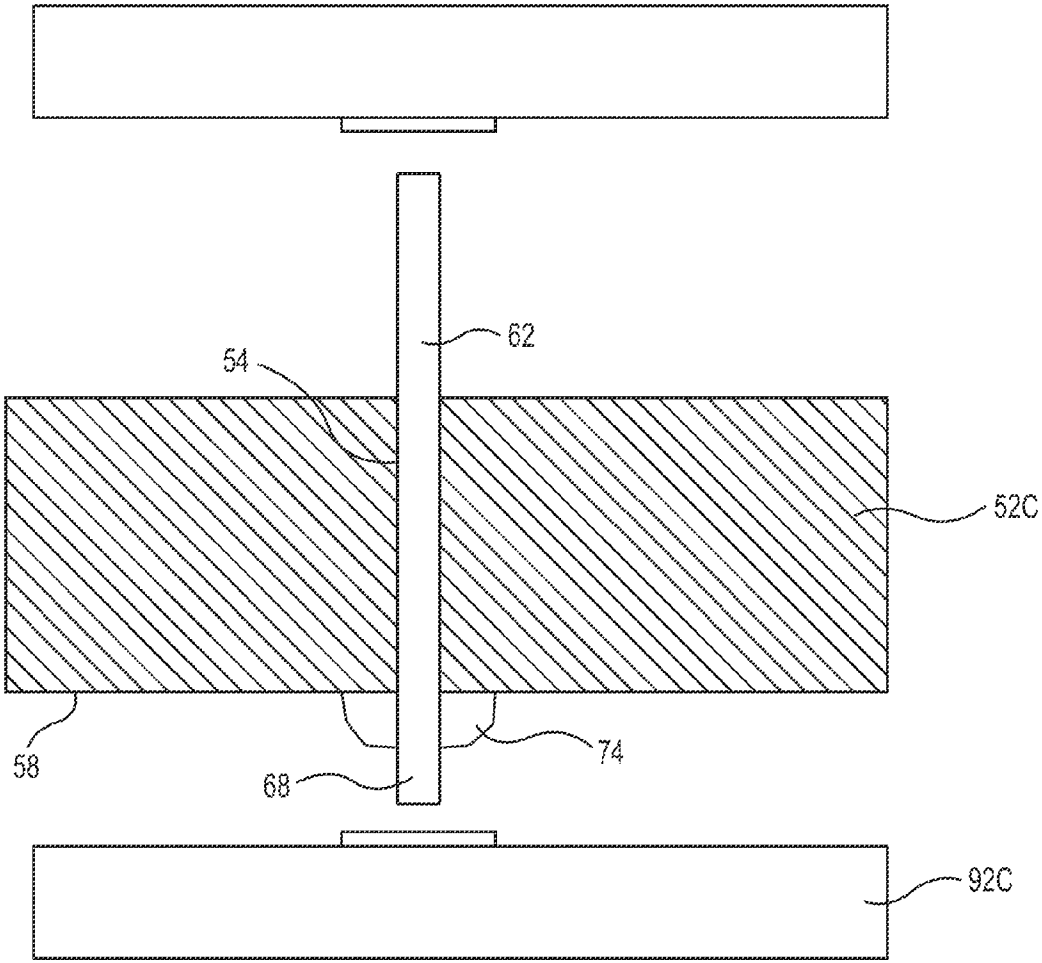
FIG. 1C is a cross-sectional view of an interconnect assembly in accordance with another embodiment of the present disclosure.

FIG. 1C is a cross-sectional view of an interconnect assembly in accordance with another embodiment having an alternate substrate 52C without a recess in the second surface 58 overlapping the through hole 54. The proximal end 68 of the contact member 62 is accessible from the second surface 58. Any of the retention members 74 discussed above can be located at the intersection of the contact member 62 with the second surface 58. In one embodiment, fixtures and/or tooling can be used to limit the depth of insertion of the contact members 62 into the substrate 52C, such as for example locating fixture 92C in proximity to the second surface 58.

Figure 2:
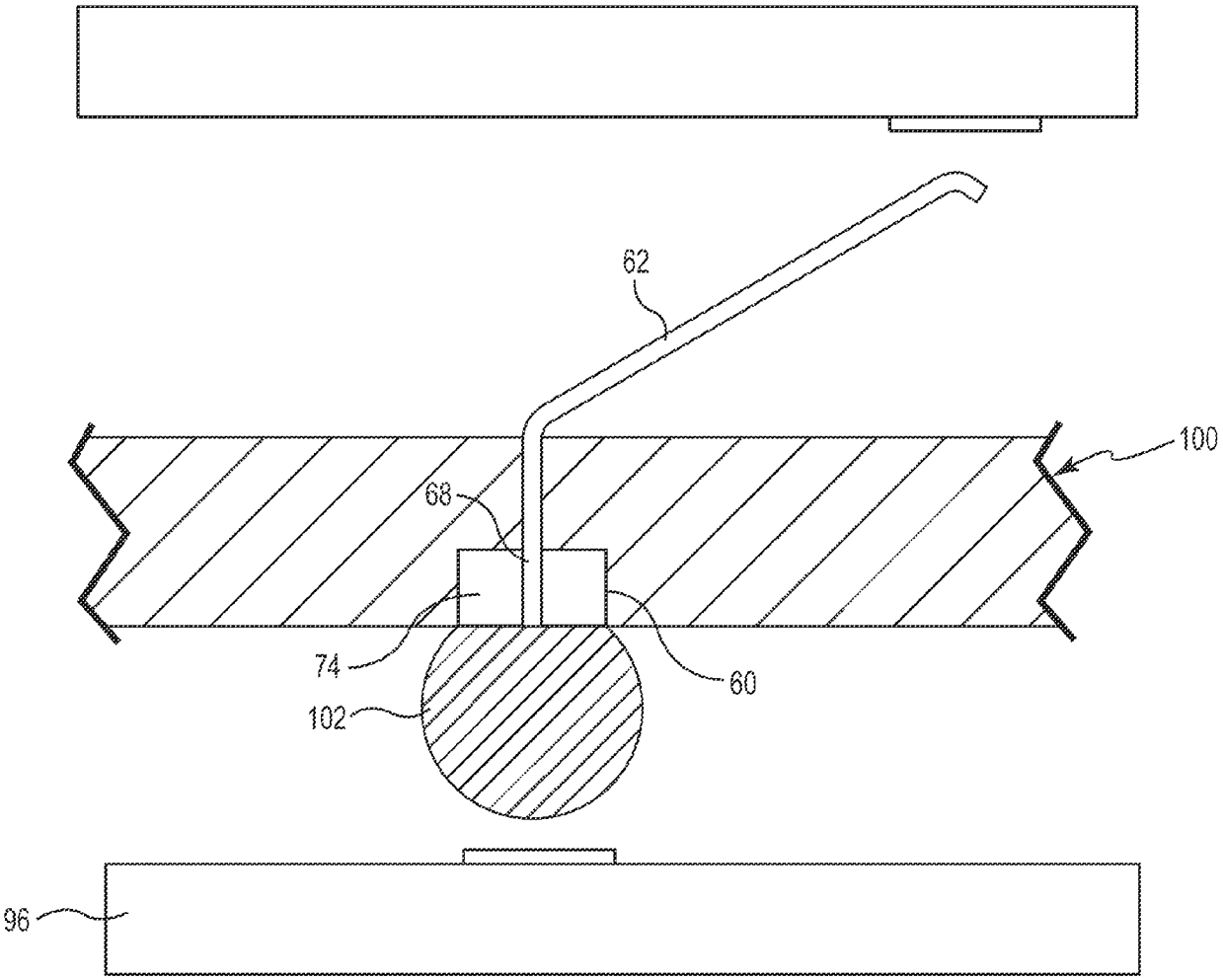
FIG. 2 is a cross-sectional view of an interconnect assembly with a solder ball electrically coupled to a retention member in accordance with another embodiment of the present disclosure.

FIG. 2 is a cross-sectional view of an interconnect assembly 100 in accordance with an embodiment of the present disclosure. Solder ball 102 is added to the metalized retention member 74 in the recess 60. In one embodiment, the solder ball 102 is printed onto the proximal end 68 of the contact member 62. The solder ball 102 may be printed, for example, using inkjet printing technology, aerosol printing technology, or other printing technology. The metallization of the recess 60 provides the wetting surface and inherently minimizes wicking of solder during reflow. In the preferred embodiment, the solder ball 102 is reflowed to provide both electrical and structural attachment to the second circuit member 96.

Figure 3:
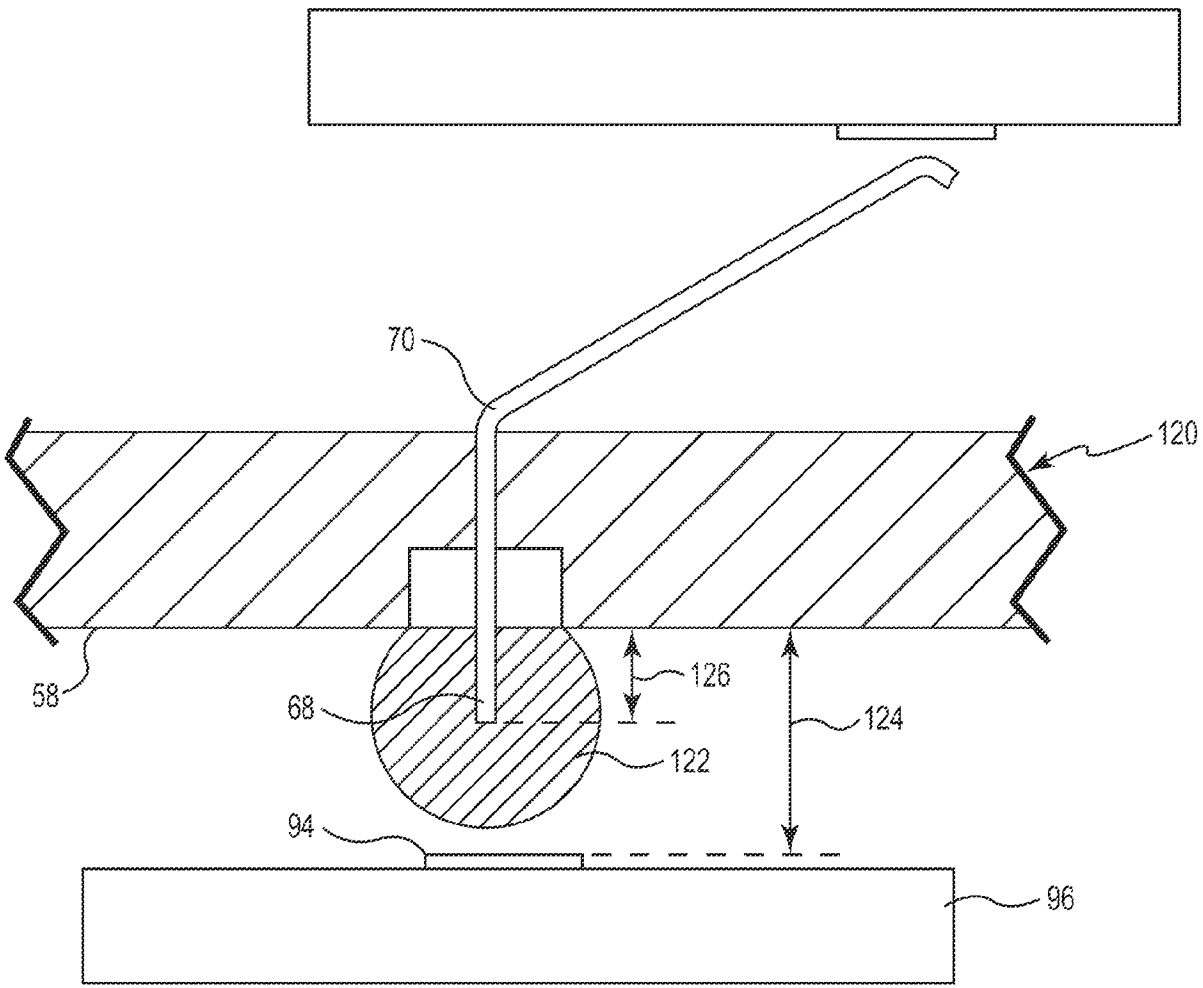
FIG. 3 is a cross-sectional view of an interconnect assembly with a proximal end of a contact member extending into a solder ball in accordance with another embodiment of the present disclosure.

FIG. 3 is a cross-sectional view of an interconnect assembly 120 in accordance with another embodiment of the present disclosure. Bend 70 is located so that proximal end 68 of the contact member 62 extends above the second surface 58. The proximal end 68 is embedded in the solder ball 122 to improve solder joint strength and resistance to shear load. Gap 124 between the second surface 58 and the contact pad 94 on the second circuit member 96 can be controlled by height 126 of the proximal end 68 above the second surface 58 or some other mechanism.

Figure 4:
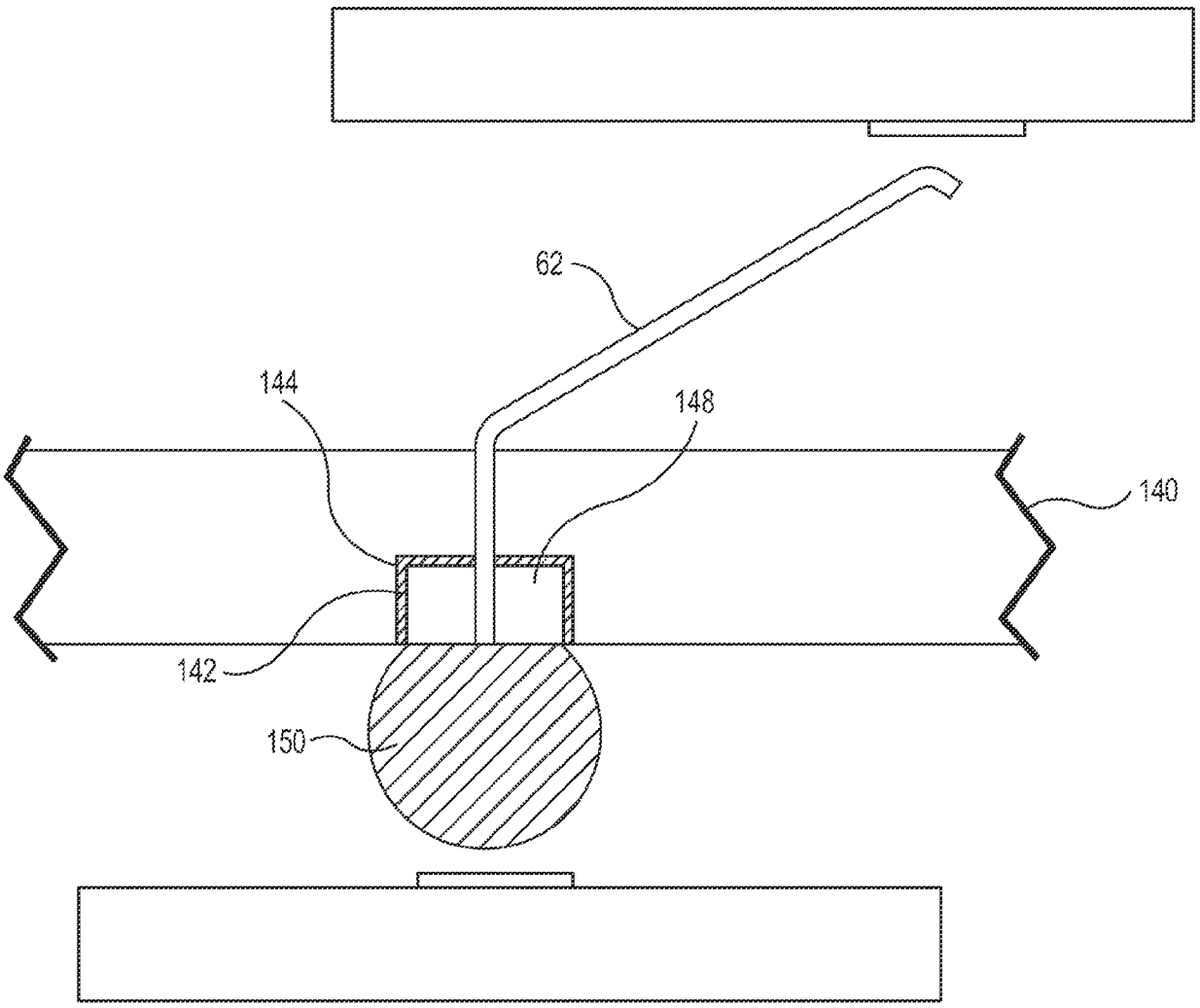
FIG. 4 is a cross-sectional view of an interconnect assembly with a dielectric material located between a substrate and a retention member in accordance with another embodiment of the present disclosure.

FIG. 4 is a cross-sectional view of an interconnect assembly 140 in accordance with another embodiment of the present disclosure. A compliant or dielectric material 142 is applied to interior surface of the recess 144. A conductive material 148 is then deposited in the recess 144. The compliant/dielectric material 142 decouples mechanical stress between the substrate 52 and the contact member 62 and/or the solder ball 150. The compliant/dielectric material 142 can also be used to alter impedance of the contact member 62.

Figure 5:
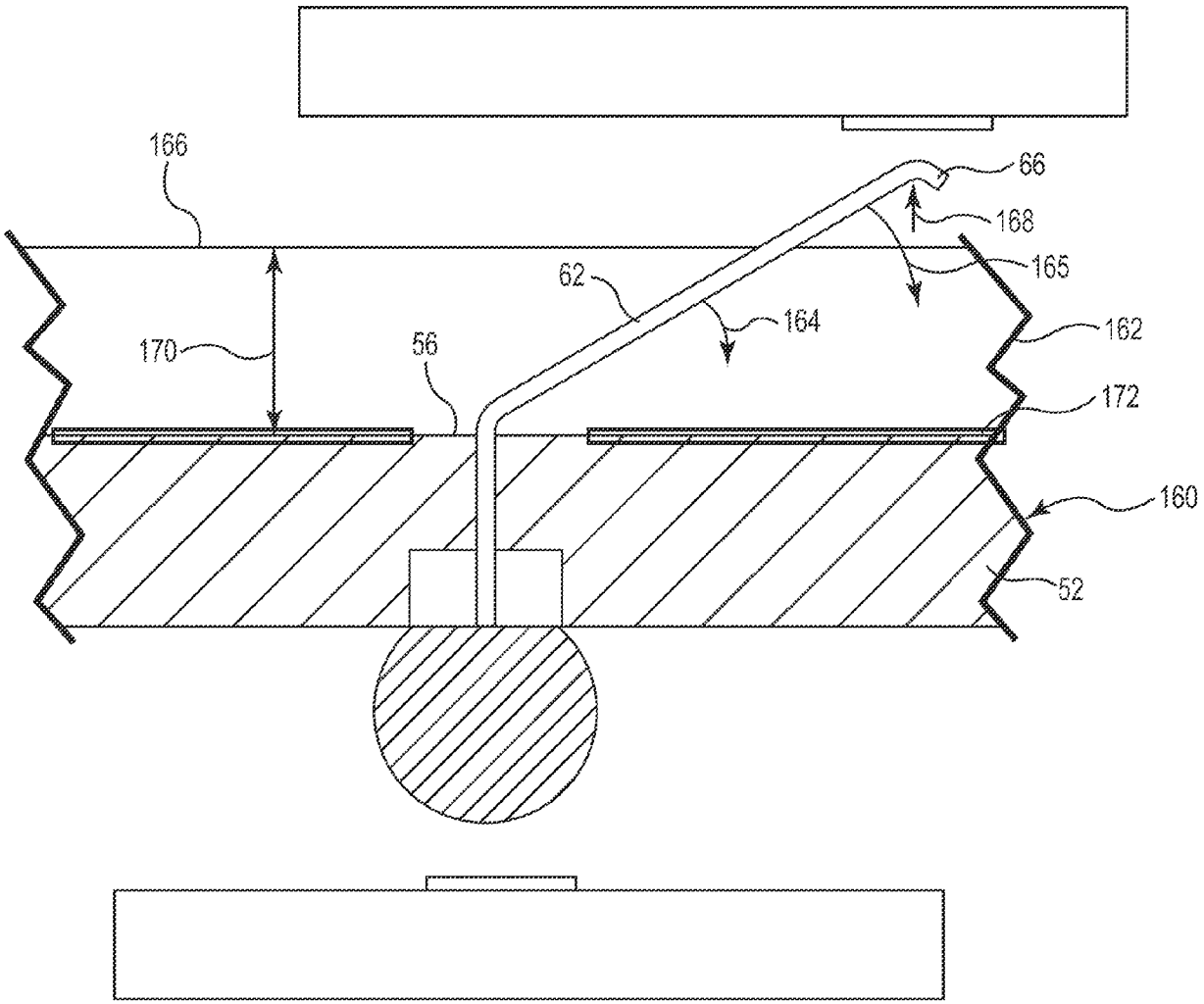
FIG. 5 is a cross-sectional view of an interconnect assembly with a dielectric material located on a first surface of a substrate in accordance with another embodiment of the present disclosure.

FIG. 5 is a cross-sectional view of an interconnect assembly 160 in accordance with another embodiment of the present disclosure. Layer 162 is bonded to the first surface 56 of the substrate 52 to perform a number of functions.

In one embodiment, the layer 162 protects the contact members 62 during shipping and assembly. In one embodiment, the layer 162 is formed in-situ on the first surface 56 of the substrate 52. In another embodiment, the layer 162 optionally includes slots that correspond with the locations of the proximal ends 66 of the contact members 62. The layer 162 can be used to limit deflection 164 of the distal end 66 to a single plane. The layer 162 can also provide a barrier between adjacent contact members 62 to prevent inadvertent electrical connections.

In another embodiment, the layer 162 isolates deflection 165 of the contact member 62 primarily to the distal end 66 located above top surface 166 of the layer 162. The resistance to deflection 168 of the distal end 66 can be adjusted by changing thickness 170 of the layer 162. In particular, decreasing the thickness 170 will reduce the force 168 required to deflect the distal end 66, and vice versa.

The layer 162 optionally stiffens the substrate 52 to reduce warpage during reflow. In one embodiment, layers 162 is made of materials such as BeCu, Cu, ceramic, or polymer filled ceramic that provide additional strength and thermal stability.

The layer 162 can also be designed to provide electrostatic dissipation or to reduce cross-talk between the contact members 62. An efficient way to prevent electrostatic discharge (ESD) is to construct the layer 162 from materials that are not too conductive but that will slowly conduct static charges away. These materials preferably have resistivity values in the range of $10^5$ to $10^{11}$ Ohm-meters. The materials discussed above for use in the substrate 52 can also be used for the layer 162.

In another embodiment, the first surface 56 can be selectively metalized to provide electromagnetic shielding 172. In one embodiment, the shielding 172 is printed onto the first surface 56 using metallic inks The shielding 172 may be printed using, for example, inkjet printing technology, aerosol printing technology, or other printing technology.

Figure 6:
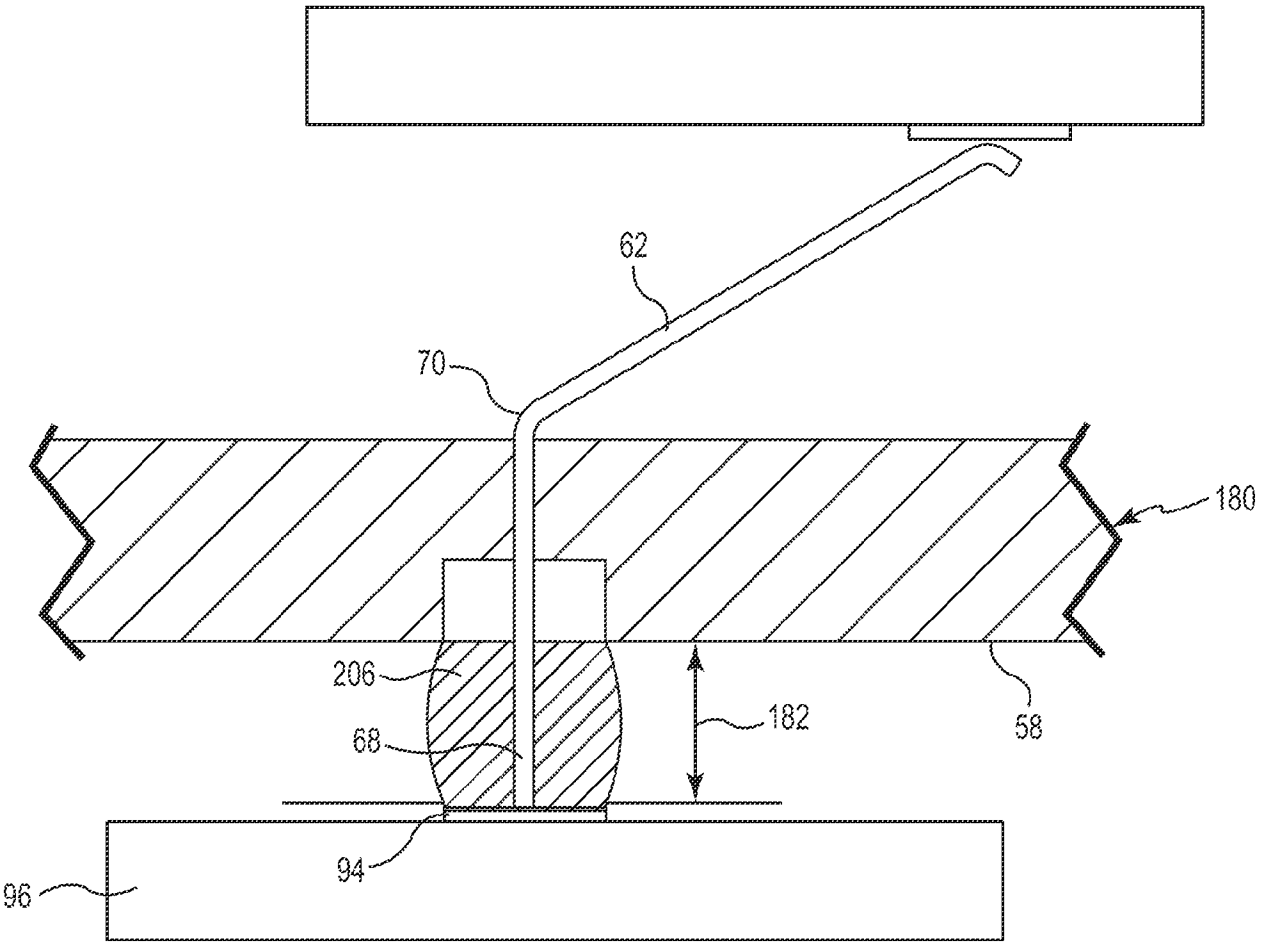
FIG. 6 is a cross-sectional view of an interconnect assembly with a proximal end of a contact member extending above a substrate in accordance with another embodiment of the present disclosure.

FIG. 6 is a cross-sectional view of an interconnect assembly 180 in accordance with another embodiment of the present disclosure. Bend 70 is located so that proximal end 68 of the contact member 62 acts as a standoff 182 between the second surface 58 of the interconnect assembly 180 and the contact pad 94 on the second circuit member 96. In one embodiment, solder or solder paste 206 is deposited onto contact pad 94, eliminating the solder ball as well as at least one high temperature cycle required to attach a solder ball to the interconnect assembly 180.

Figure 7:
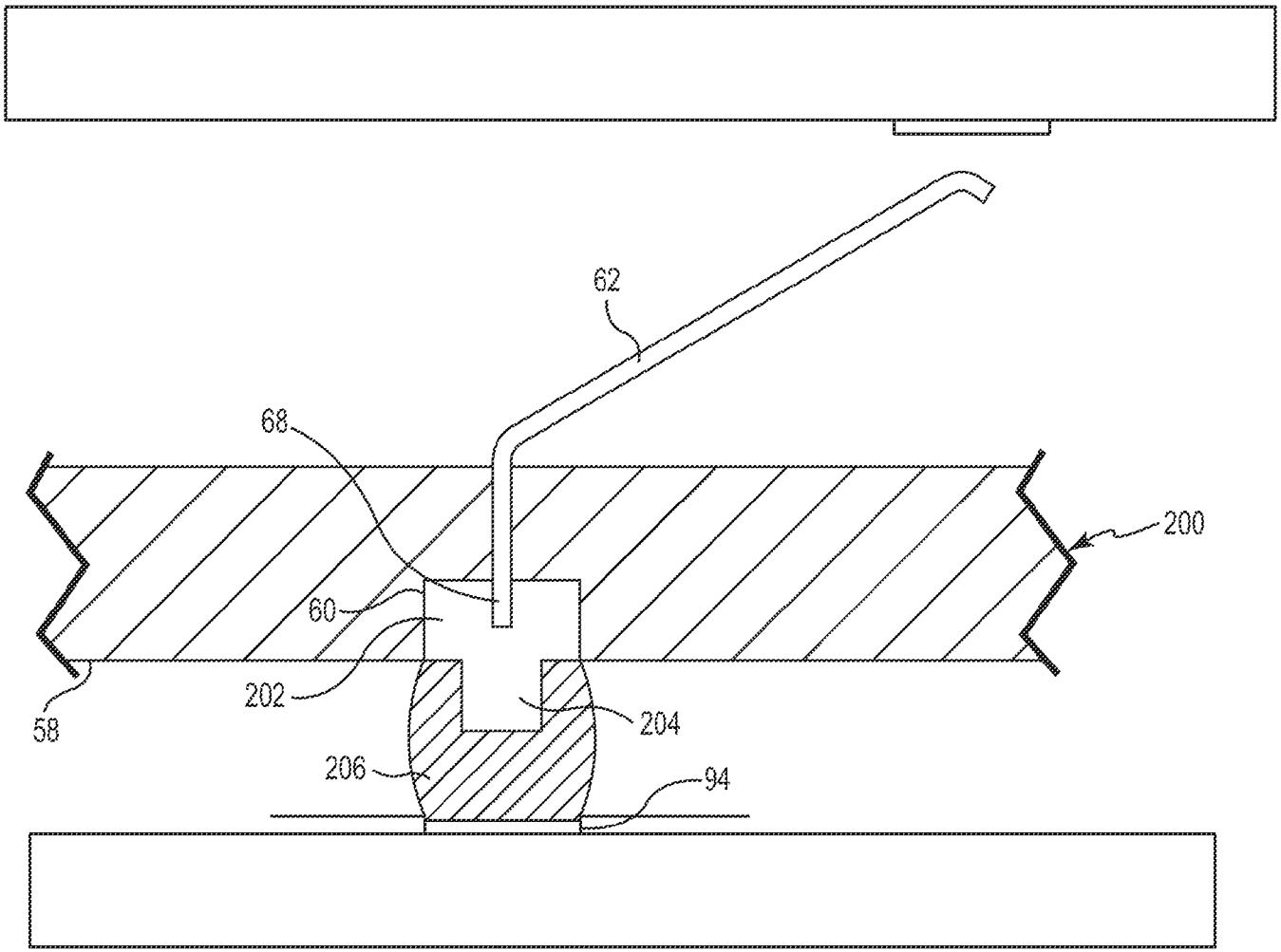
FIG. 7 is a cross-sectional view of an interconnect assembly with a retention member extending above a substrate in accordance with another embodiment of the present disclosure.

FIG. 7 is a cross-sectional view of an interconnect assembly 200 in accordance with another embodiment of the present disclosure. Conductive retention member 202 bonds to the proximal end 68 of the contact member 62 and extends above second surface 58 of the substrate 52. In the illustrated embodiment, portion 204 of the retention member 202 has a smaller cross section than the recess 60. Solder or solder paste 206 is preferably deposited onto contact pad 94, eliminating the solder ball as well as at least one high temperature cycle required to attach a solder ball to the interconnect assembly 200. In one embodiment, the metalized retention member 202 is deposited using photolithographic or printing technology, such as for example inkjet printing technology, aerosol printing technology, or other printing technology.

Figure 8:
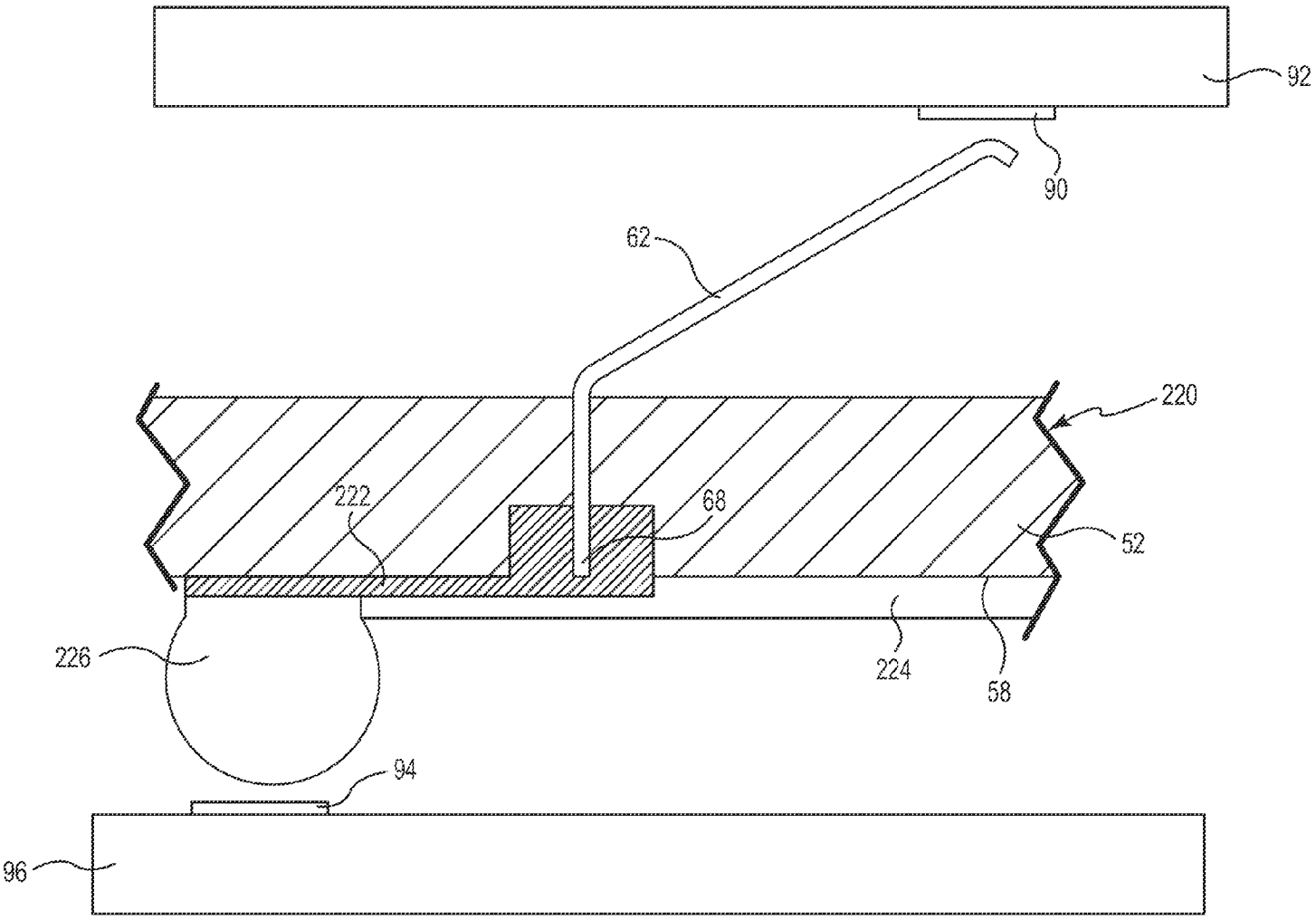
FIGS. 8 and 9 are cross-sectional views of alternate embodiments of interconnect assemblies with conductive traces on a substrate in accordance with another embodiment of the present disclosure.
Figure 9:
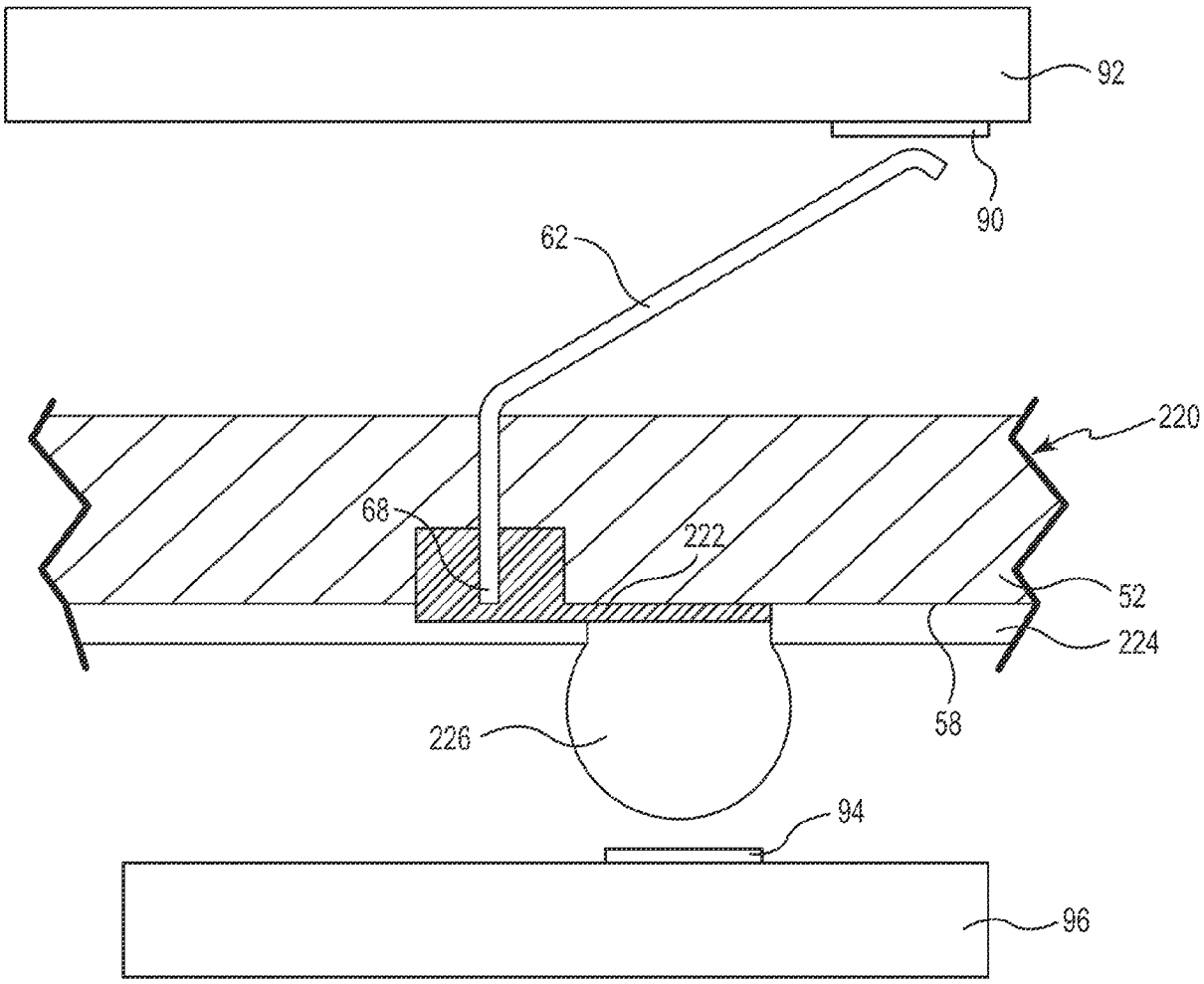

FIGS. 8 and 9 are alternate embodiments of an interconnect assembly 220 in accordance with another embodiment of the present disclosure. Conductive traces 222 can be added to the second surface 58 to create an offset or redistribution of the pitch of the contact pads 90 on the first circuit member 92 relative to the contact pads 94 on the second circuit member 96. Dielectric layer 224 is preferably deposited over the conductive traces 222.

The conductive traces 222 can be used to alter, redirect, or reduce the effective termination pitch of the first circuit member 92. The second surface 58 of the substrate 52 is treated like a printed circuit board, onto which various electrical device can be added, such as for example by inkjet printing technology, aerosol printing technology, or other printing technology. In the illustrated embodiments, the conductive traces 222 electrically couple the proximal ends 68 of the contact members 62 with solder ball 226.

The resulting circuit geometry preferably has conductive traces that have substantially rectangular cross-sectional shapes. In one embodiment, pre-formed conductive trace materials are positioned in recesses or trenches in the second surface 58 of the substrate 52. The recesses can be plated to form conductive traces with substantially rectangular cross-sectional shapes. In another embodiment, a conductive foil is pressed into at least a portion of the recesses. The conductive foil is sheared along edges of the recesses. The excess conductive foil not located in the recesses is removed and the recesses are plated to form conductive traces with substantially rectangular cross-sectional shape.

Figure 10:
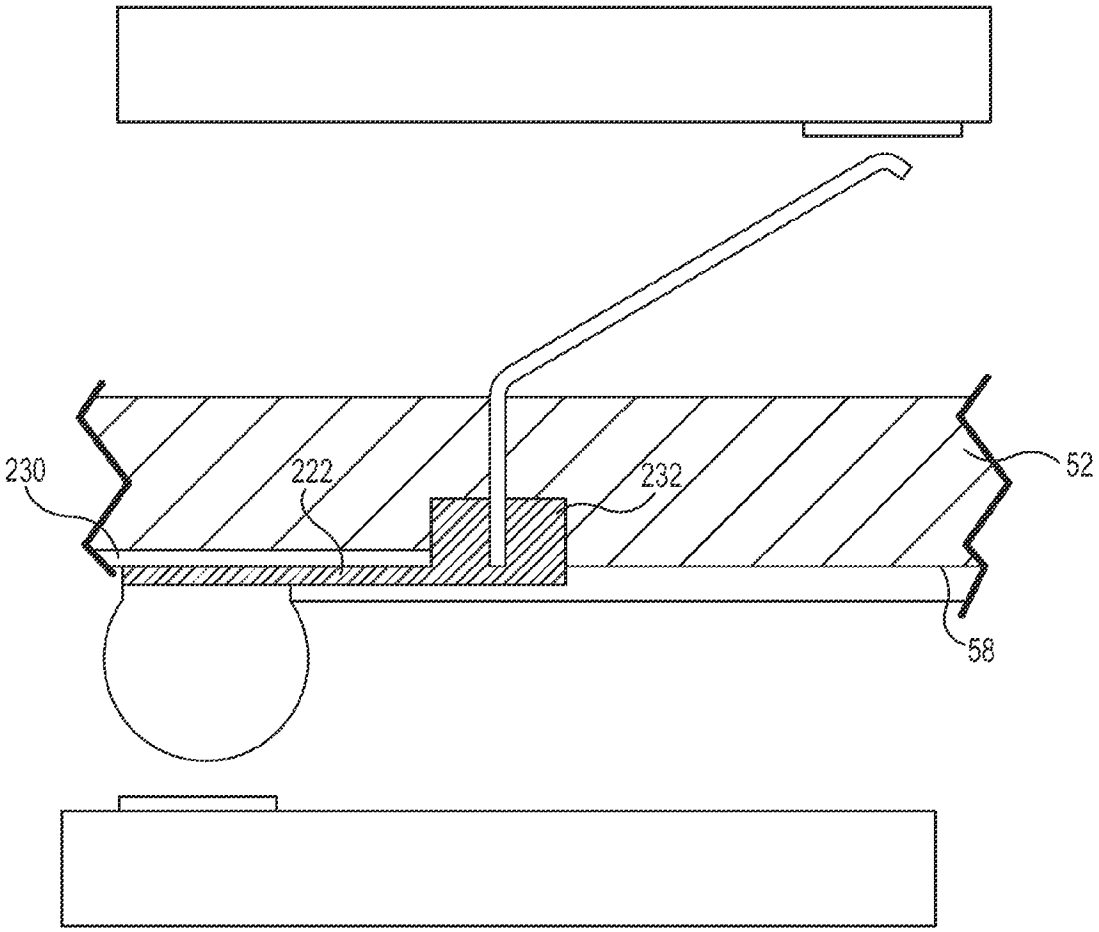
FIGS. 10 and 11 are cross-sectional views of alternate embodiments of the interconnect assemblies of FIGS. 8 and 9 with conductive traces supported by a compliant layer in accordance with other embodiments of the present disclosure.
Figure 11:
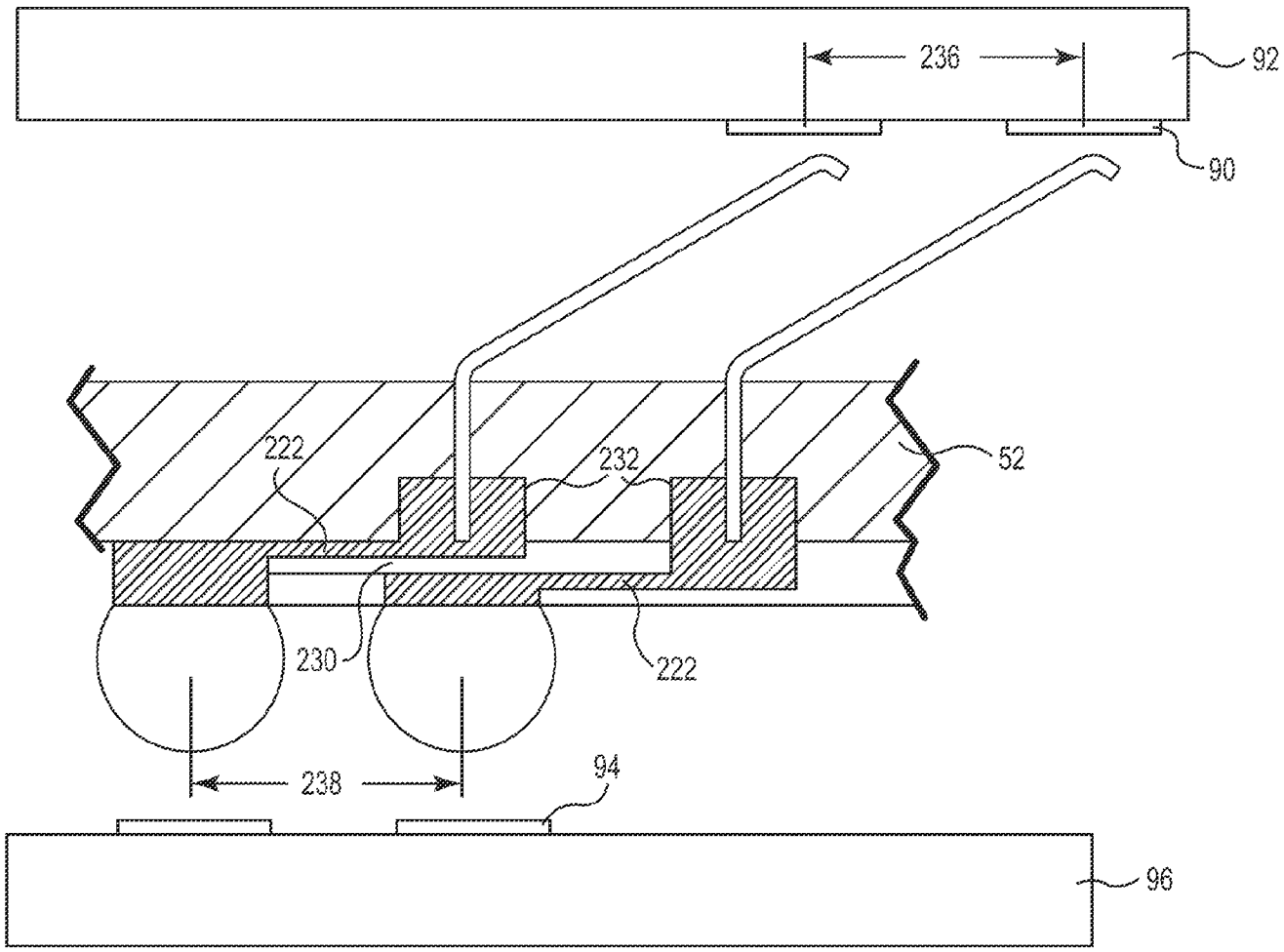

FIGS. 10 and 11 are cross sectional views of alternate embodiments of the interconnect assembly 220 of FIGS. 8 and 9. A compliant decoupling layer 230 is located between the conductive traces 222 and the second surface 58 of the substrate 52 or between adjacent conductive traces 222. The compliant decoupling layer 230 improves joint reliability and reduces internal stress. A compliant decoupling layer 230 can also be added between the metalized recess 232 and the substrate 52 to decouple thermal expansion and loading stresses. The compliant decoupling layer can be formed by inkjet printing technology, aerosol printing technology, or other printing technology. The embodiments of FIGS. 10 and 11 merge features of sockets, PCB and/or semiconductor packages. The conductive traces 222 have substantially rectangular cross-sectional shapes.

The embodiment of FIG. 11 illustrates the contact pads 90 on the first circuit member 92 having first pitch 236 and the contact pads 94 on the second circuit member 96 having second pitch 238. The first and second pitches 236, 238 can be the same or different. In the illustrated embodiment, the first pitch 236 can be modified and/or offset by the conductive traces 222.

Figure 12:
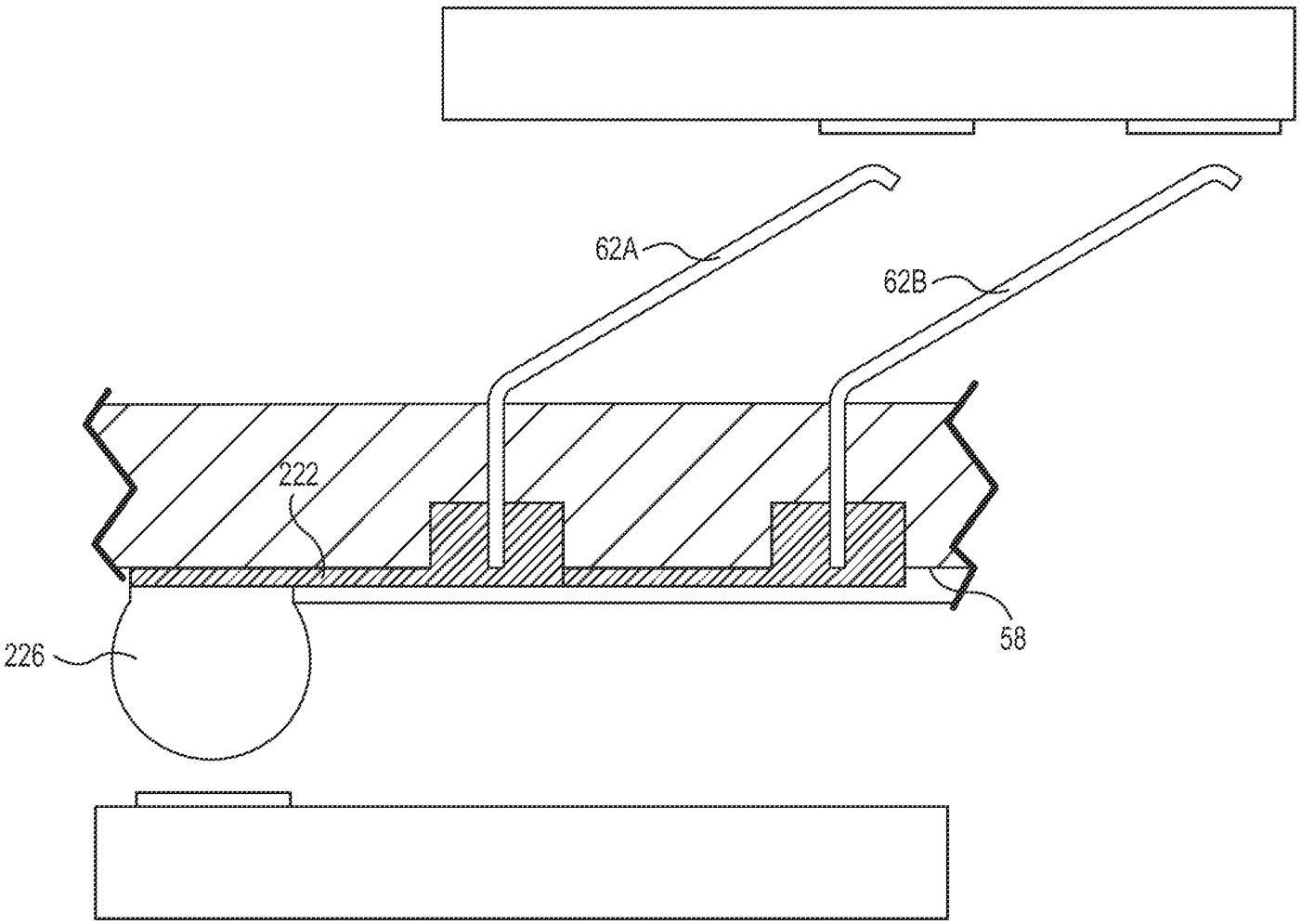
FIG. 12 is a cross-sectional view of an interconnect assembly with conductive traces electrically coupling a plurality of contact members to a point in accordance with another embodiment of the present disclosure.

FIG. 12 is a cross-sectional view of an interconnect assembly according to another embodiment where the conductive traces 222 formed on the second surface 58 of the substrate 52 are used to create an internal ground plane, resulting in a reduction of ground connections to the second circuit member 96. Both contact members 62A and 62B are electrically coupled to a single solder ball 226 by conductive traces 222. The conductive traces 222 have substantially rectangular cross-sectional shapes.

Figure 13:
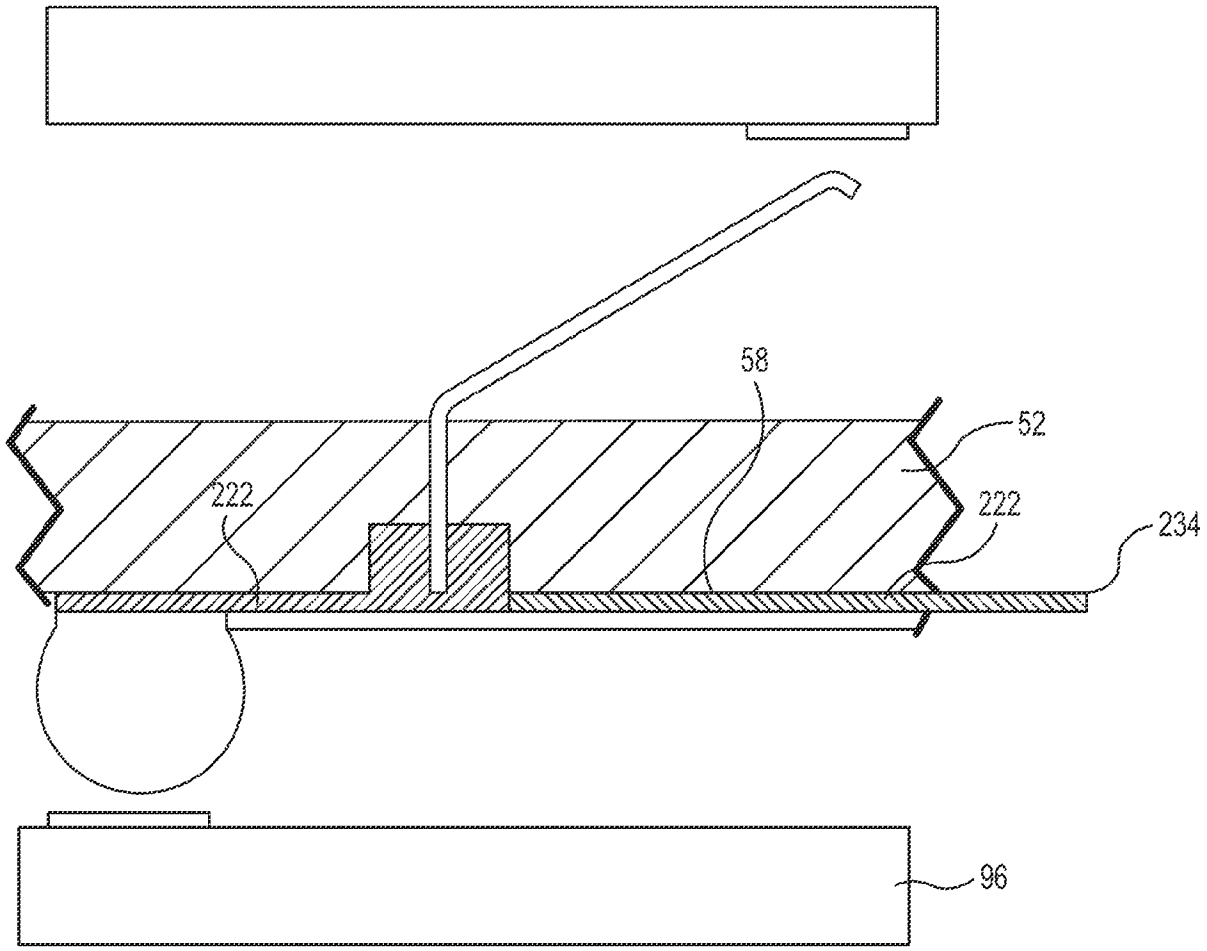
FIG. 13 is a cross-sectional view of an interconnect assembly with conductive traces electrically coupling a plurality of contact members to location external to the substrate in accordance with another embodiment of the present disclosure.

FIG. 13 is a cross-sectional view of an interconnect assembly according to another embodiment where the conductive traces 222 formed on the second surface 58 of the substrate 52 are used as a power management circuit. The conductive traces 222 can be formed by inkjet printing technology, aerosol printing technology, or other printing technology. The conductive traces 222 can deliver, condition, and manage power from an external connection 234 separate from power provided by the second circuit member 96. As illustrated, the conductive traces 222 may extend beyond a perimeter edge of the substrate to the external connection 234. The conductive traces 222 have substantially rectangular cross-sectional shapes.

Figure 14:
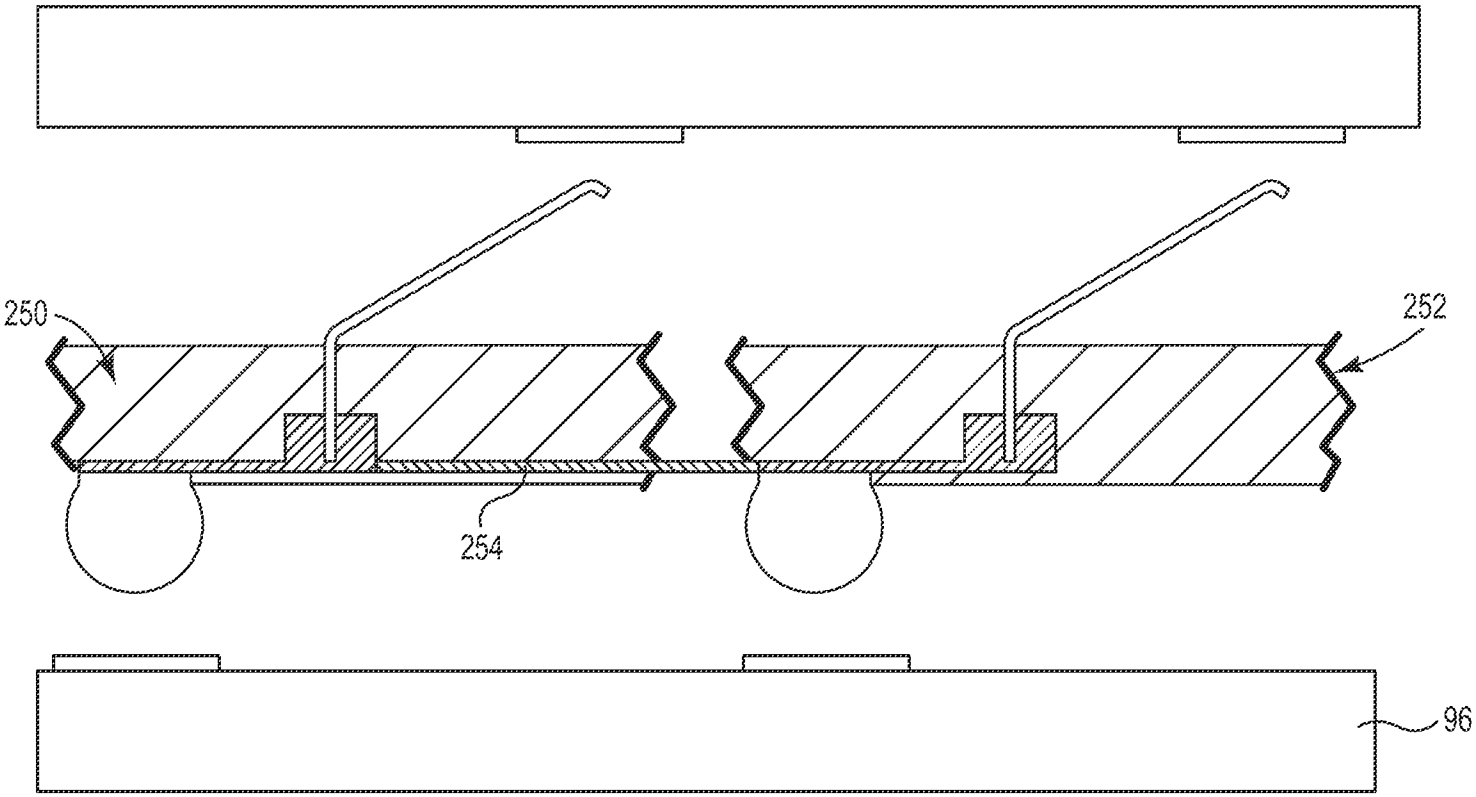
FIG. 14 is a cross-sectional view of two interconnect assemblies electrically coupled by conductive traces in accordance with another embodiment of the present disclosure.

FIG. 14 is a cross-sectional view of a pair of interconnect assemblies 250, 252 coupled together in accordance with another embodiment of the present disclosure. The interconnect assemblies use conductive traces 254 to create a socket-to-socket connection external to the second circuit member 96. The second circuit may be a main PCB. In some embodiments, a direct socket-to-socket connection provides a flexible high frequency interface.

Figure 15:
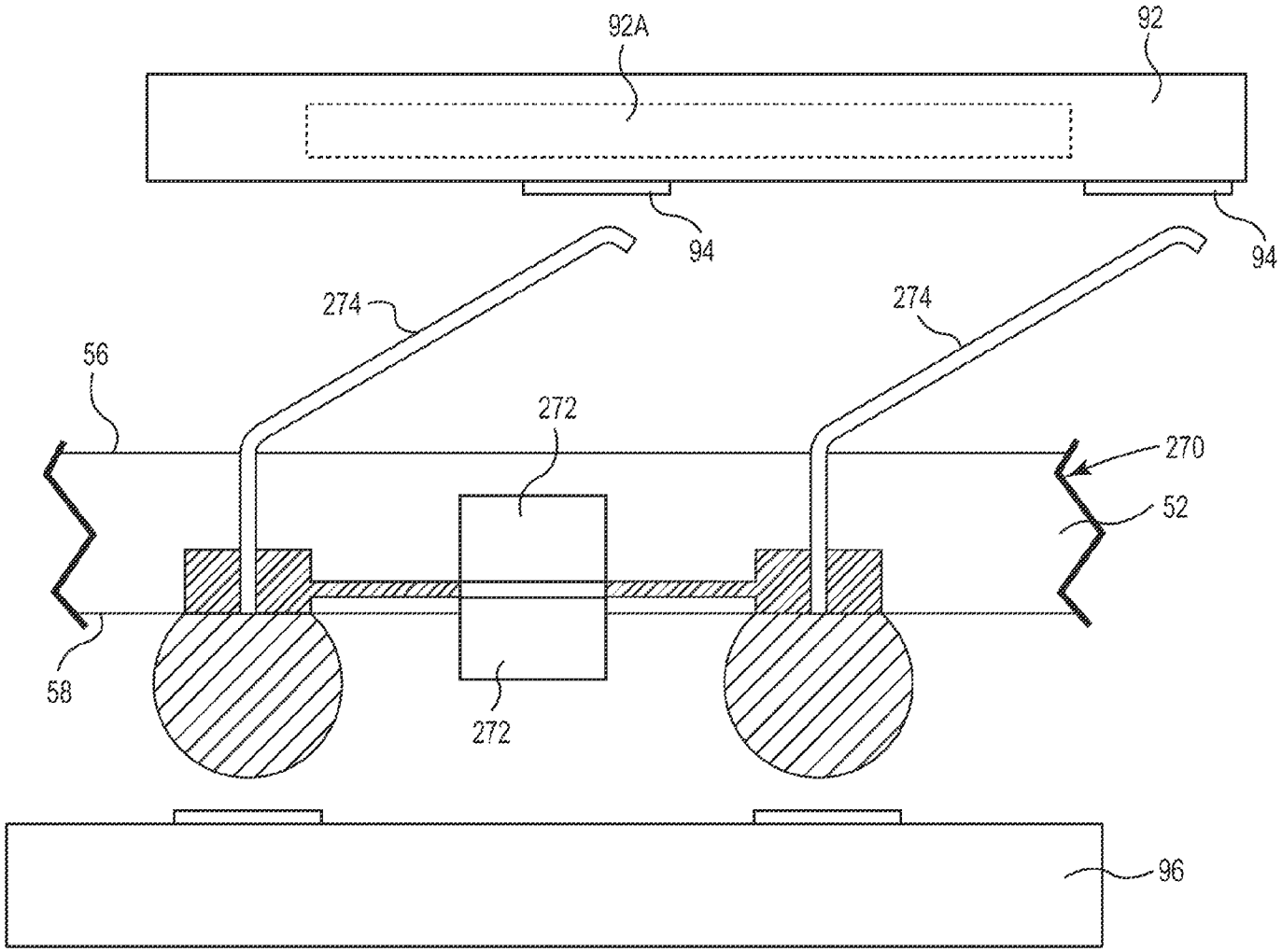
FIGS. 15 and 16 are cross-sectional views of interconnect assemblies including other electrical devices in accordance with other embodiments of the present disclosure.
Figure 16:
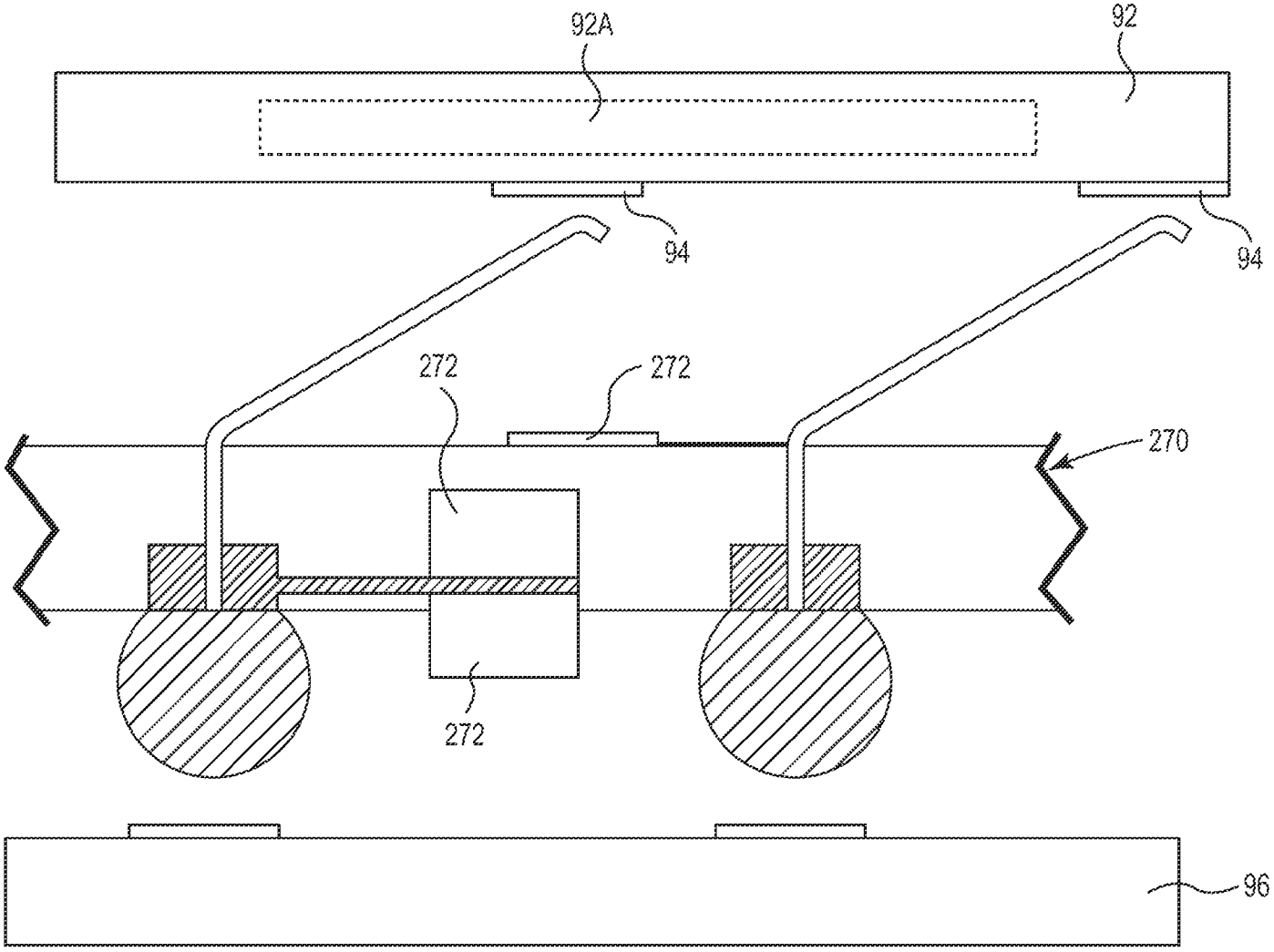

FIGS. 15 and 16 are cross-sectional views of interconnect assembly 270 containing additional electrical devices 272 in accordance with other embodiments of the present disclosure. The electrical devices 272 can be a power plane, ground plane, capacitor, resistor, filters, signal or power altering and enhancing device, memory device, embedded IC, RF antennae, and the like. The electrical devices 272 can be located on either surface 56, 58 of the substrate 52, or embedded therein. The electrical devices 272 can include passive or active functional elements. Passive structure refers to a structure having a desired electrical, magnetic, or other property, including but not limited to a conductor, resistor, capacitor, inductor, insulator, dielectric, suppressor, filter, varistor, ferromagnet, and the like.

FIGS. 15 and 16 illustrate the electrical devices 272 as internal decoupling capacitors located on the substrate 52 or within the interconnect assembly 270 between contact members 274. The electrical devices 272 can be added as discrete components or printed materials, reducing the need for discrete components on the first and second circuit members 92, 96. Moving the decoupling capacitors 272 closer to the first circuit member 92 also increases performance of the first circuit member 92.

The availability of printable silicon inks provides the ability to print the electrical devices 272, such as disclosed in the patents previously referenced and incorporated herein by reference. For example, the electrical devices 272 can be formed using printing technology, adding intelligence to the interconnect assembly 270. In particular, features that are typically located on the first or second circuit members 92, 96 can be incorporated into the interconnect assembly 270 in accordance with an embodiment of the present disclosure. According to one embodiment, the first circuit member 92 may comprise a package 92 having an integrated circuit 92A. The second circuit member 96 may be a PCB 96.

Locating such electrical devices on the interconnect assembly improves performance and enables a reduction in the cost of the integrated circuit 92A, the package 92, and the PCB 96. Integrated circuit manufactures are limited by the pitch that the PCB 96 can accommodate and still keep the printed circuit board to four layers. The integrated circuit makers can manufacture the package 92 with a smaller pitch, but with the pin counts is so high that the PCB 96 likely requires additional layers in order to route all of the signals.

The present interconnect assembly permits integrated circuit manufactures to reduce the pitch of the contacts 94 on the package 92, and perform any required signal routing in the interconnect assembly, rather than in the PCB 96 or by adding daughter boards to the system.

Integrated circuit manufactures also are limited by current socket designs when designing the configuration of contacts 94 on the package 92. Performing the routing in the present interconnect assembly permits quick and inexpensive changes. Similarly, locating the electrical devices 272 in the interconnect assembly permits integrated circuit manufactures to reduce or eliminate the capacitors currently located on the package 92 and PCB 96. This shift can greatly reduce cost and simplify the package 92 and PCB 96, while improving performance.

One of the reasons the contact members on prior art socket are so long (typically about 3 millimeters) is to provide clearance for the capacitors on the package 92 and the PCB 96 when the integrated circuit is put into the socket. Locating transistors and memory in the present interconnect assembly will permit the contact members to be shorter, which will improve the performance of the contacts.

Figure 17:
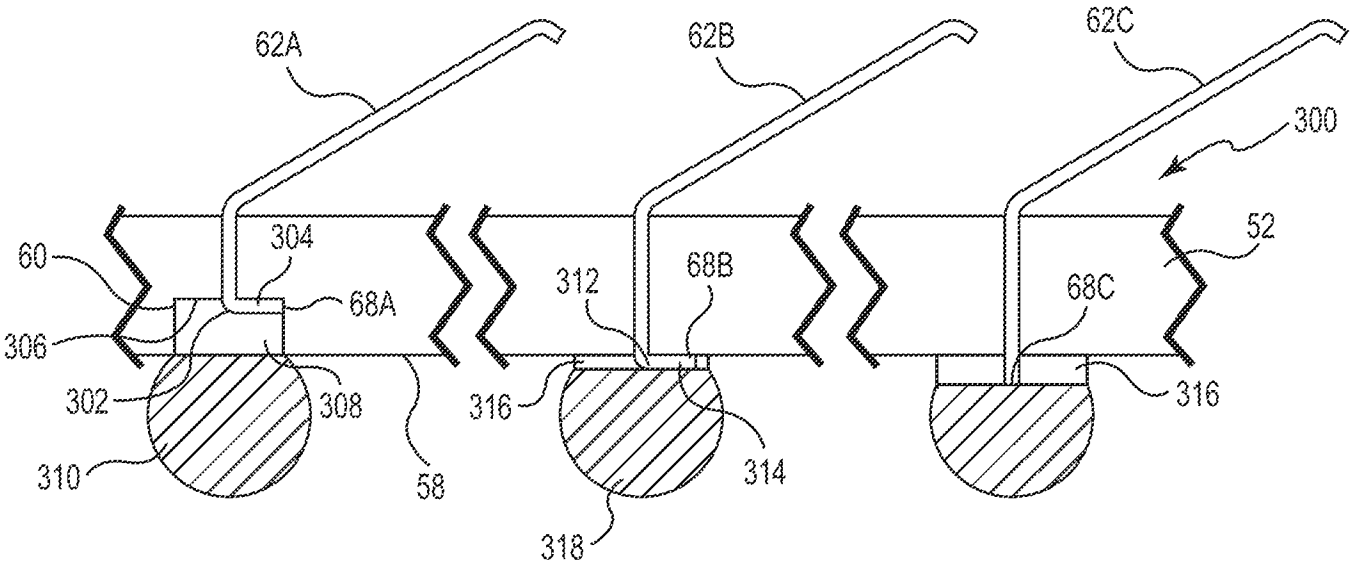
FIG. 17 is a cross-sectional view of an interconnect assembly with retention tabs on contact members in accordance with another embodiment of the present disclosure.

FIG. 17 is a cross-sectional view of an interconnect assembly 300 with various methods for securing contact members 62A-62C to the substrate 52 in accordance with other embodiments of the present disclosure. Proximal end 68A of contact member 62A is folded at location 302 to form retention tab 304. Retention tab 304 abuts bottom surface 306 of recess 60. Retention member 308 secures the retention tab 304 in the recess 60 and provides a surface for securing solder ball 310.

Proximal end 68B of contact member 62B is folded at location 312 to form retention tab 314. Retention tab 314 abuts second surface 58 of the substrate 52. No recess 60 is required. The retention tab 314 is secured to the substrate 52 by a retention member 316, such as for example a metal layer of sintered particles or metal plating. The retention member 316 also controls solder wetting during deposition of solder ball 318. Similarly, proximal end 68C of contact member 62C is also retained to the substrate 52 by a retention member 316.

Figure 18:
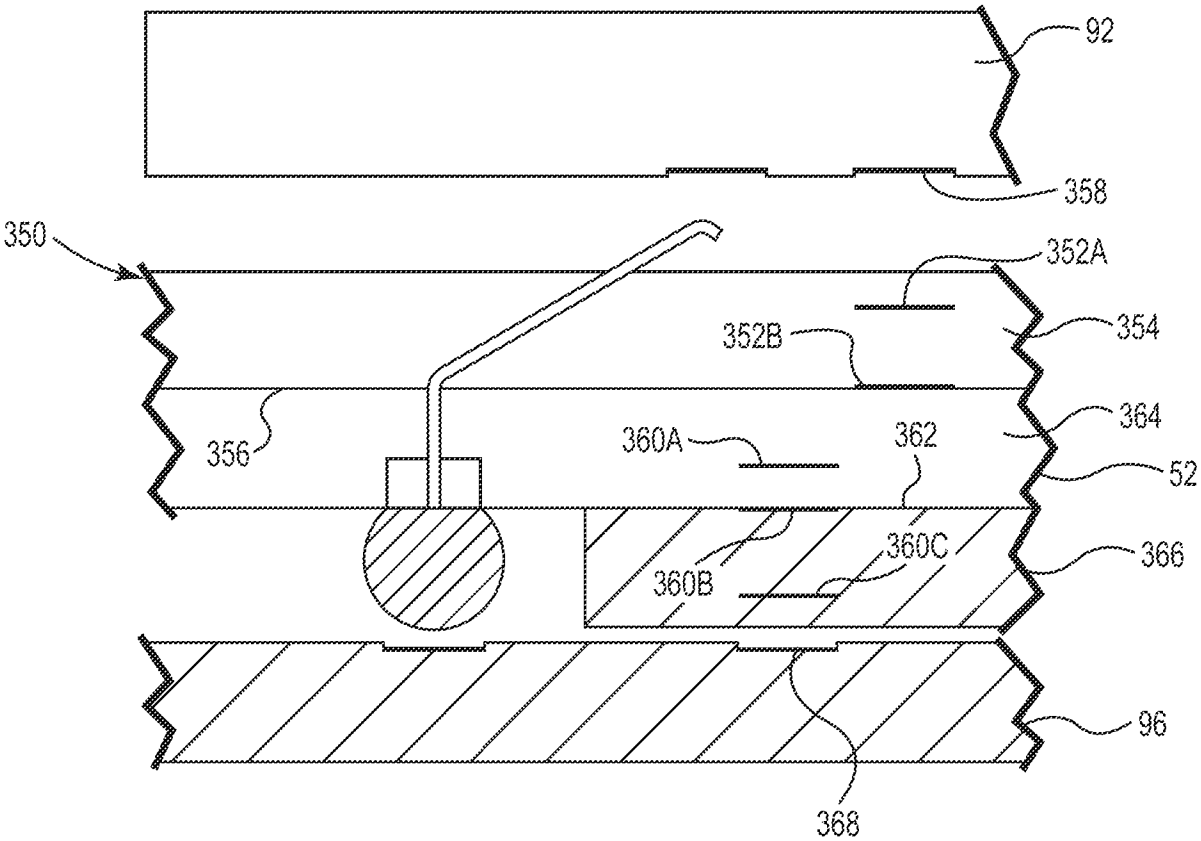
FIG. 18 is a cross-sectional view of an interconnect assembly with capacitive coupling features in accordance with another embodiment of the present disclosure.

FIG. 18 is a cross-sectional view of an interconnect assembly 350 with various capacitive coupling features in accordance with another embodiment of the present disclosure. A capacitive coupling feature 352A is embedded in layer 354 of the substrate 52. A capacitive coupling feature 352B is located on second surface 356 of the layer 354. The capacitive coupling features 352A, 352B are positioned to electrically couple with contact pad 358 on first circuit member 92.

Capacitive coupling feature 360A is embedded in a layer 364 of the substrate 52. Capacitive coupling feature 360B is located on first surface 362 of the layer 364. The capacitive coupling features 360C is embedded in layer 366. All three capacitive coupling features 360A, 360B, 360C are positioned to electrically couple with contact pad 368 on the second member 96. The various capacitive coupling features in the embodiment of FIG. 18 are optionally formed using inkjet printing technology, aerosol printing technology, or other printing technology.

Where a range of values is provided, it is understood that each intervening value, to the tenth of the unit of the lower limit unless the context clearly dictates otherwise, between the upper and lower limit of that range and any other stated or intervening value in that stated range is encompassed within the embodiments of the invention . The upper and lower limits of these smaller ranges which may independently be included in the smaller ranges is also encompassed within the embodiments of the invention, subject to any specifically excluded limit in the stated range. Where the stated range includes one or both of the limits, ranges excluding either both of those included limits are also included in the embodiments of the invention.

Unless defined otherwise, all technical and scientific terms used herein have the same meaning as commonly understood by one of ordinary skill in the art to which the embodiments of the present disclosure belong. Although any methods and materials similar or equivalent to those described herein can also be used in the practice or testing of the embodiments of the present disclosure, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the present disclosure. It should be understood that various features and aspects of the disclosed embodiments can be combined with or substituted for one another in order to form varying modes of the disclosed embodiments of the invention. Thus, it is intended that the scope of the present disclosure herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment(s) that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. An interconnect assembly comprising:

a substrate comprising a plurality of through holes extending from a first major surface to a second major surface, each through holes comprising an axis and a cross-sectional area generally perpendicular to the axis;

a plurality of recesses in the second major surface of the substrate that at least partially overlap with the plurality of through holes, each recess comprising a recess axis and a recess cross-sectional area generally perpendicular to the recess axis, the recess cross-sectional area of the recess being greater than the cross-sectional area of the through holes;

a plurality of discrete contact members in the plurality of the through holes, the contact members comprising proximal ends extending into the recesses, distal ends extending above the first major surface, and intermediate portions engaged with an engagement region of the substrate located between the first major surface and the recesses; and a plurality of electrically conductive retention members at least partially located in the recesses and bonded the proximal ends of the contact members to retain the contact members in the through holes;

wherein a compliant material or a dielectric material is in between the retention members and at least a portion of an inner surface of the recesses.

2. The interconnect assembly of claim 1 wherein the electrically conductive retention members comprise one or more of solder, solder paste, a conductive plug, a conductive adhesive, electrical plating, or a combination thereof.

3. The interconnect assembly of claim 1 wherein the substrate comprises a plurality of layers.

4. The interconnect assembly of claim 3 wherein the substrate comprises at least one additional circuitry plane comprising one of a ground plane, a power plane, an electrical connection to other circuit members, a dielectric layer, a printed circuit board, a flexible circuit, a bare die device, an integrated circuit device, organic or inorganic substrates, or a rigid circuit.

5. The interconnect assembly of claim 1 wherein the intermediate portion of each of the plurality of contact members forms a friction fit with the engagement region of the substrate.

6. The interconnect assembly of claim 1 comprising a solder ball attached to the retention member and electrically coupled to the proximal ends of each of the plurality of contact members.

7. The interconnect assembly of claim 1 comprising:

proximal end of each of the plurality of contact members extending above the second surface; and solder balls coupled to the proximal ends.

8. The interconnect assembly of claim 1 further comprising a layer of dielectric material bonded to the first surface of the substrate.

9. The interconnect assembly of claim 8 wherein the layer of dielectric material limits deflection of the distal ends of the plurality of contact members.

10. The interconnect assembly of claim 1 further comprising:

a plurality of conductive traces located on at least one of the first and second surfaces of the substrate and electrically coupled to the plurality of contact members; and a dielectric layer electrically insulating the conductive traces.

11. The interconnect assembly of claim 10 wherein the plurality of conductive traces comprise distal ends with a pitch different than a pitch of the proximal ends of the plurality of contact members.

12. The interconnect assembly of claim 10 comprising a compliant layer located between one of the second surface and the plurality of conductive traces or between overlapping conductive traces.

13. The interconnect assembly of claim 10 comprising a flexible circuit member electrically coupled to the plurality of conductive traces and extending beyond a perimeter edge of the substrate.

14. The interconnect assembly of claim 10 wherein the plurality of conductive traces electrically couple the interconnect assembly with a second interconnect assembly.

15. The interconnect assembly of claim 10 comprising a plurality of electrical devices printed on at least one of the first or second surfaces of the substrate and electrically coupled to at least one of the plurality of contact members.

16. An electrical assembly comprising:

the interconnect assembly of claim 1;

a first circuit member comprising contact pads compressively engaged with the distal ends of the plurality of contact members; and a second circuit member comprising contact pads bonded to one or more of the retention members or one or more of the proximal ends of the plurality of contact members.

17. An interconnect assembly comprising:

a substrate comprising a plurality of through holes extending from a first major surface to a second major surface, each through holes comprising an axis and a cross-sectional area generally perpendicular to the axis;

a plurality of recesses in the second major surface of the substrate that at least partially overlap with the plurality of through holes, each recess comprising a recess axis and a recess cross-sectional area generally perpendicular to the recess axis, the recess cross-sectional area of the recess being greater than the cross-sectional area of the through holes;

a plurality of discrete contact members in the plurality of the through holes, the contact members comprising proximal ends extending into the recesses, distal ends extending above the first major surface, and intermediate portions engaged with an engagement region of the substrate located between the first major surface and the recesses;

a plurality of retention members at least partially located in the recesses and bonded the proximal ends of the contact members to retain the contact members in the through holes; and a solder ball electrically coupled to the proximal ends of the contact members and extending above the second surface of the substrate;

wherein a complaint material or a dielectric material is in between the retention members and at least a portion of an inner surface of the recesses.

* * * * *